US010093113B2

(12) United States Patent
Hojo

(10) Patent No.: US 10,093,113 B2
(45) Date of Patent: Oct. 9, 2018

(54) IMAGE-FORMING DEVICE AND METHOD FOR APPLYING VARNISH

(71) Applicant: FUJIFILM Corporation, Tokyo (JP)

(72) Inventor: Hiroaki Hojo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/619,545

(22) Filed: Jun. 12, 2017

(65) Prior Publication Data

US 2017/0355201 A1 Dec. 14, 2017

(30) Foreign Application Priority Data

Jun. 13, 2016 (JP) ..... 2016-117234

(51) Int. Cl.
*B41J 11/00* (2006.01)
*B41M 7/02* (2006.01)
*B41J 29/377* (2006.01)

(52) U.S. Cl.
CPC ..... *B41J 11/0015* (2013.01); *B41J 11/002* (2013.01); *B41J 29/377* (2013.01); *B41M 7/02* (2013.01)

(58) Field of Classification Search
CPC .... B41J 11/0015; B41J 11/002; B41J 29/377; B41M 7/02
See application file for complete search history.

(56) References Cited

U.S. PATENT DOCUMENTS

2007/0089623 A1* 4/2007 Hamamoto ..... B41F 23/044 101/424.1
2007/0282037 A1* 12/2007 Anderson ..... B41M 7/02 524/31
2008/0311299 A1* 12/2008 Furukawa ..... B41J 3/44 427/261
2013/0307890 A1 11/2013 Abergel
2015/0246556 A1 9/2015 Houjou
(Continued)

FOREIGN PATENT DOCUMENTS

| | | |
|---|---|---|
| EP | 1777069 | 4/2007 |
| JP | 2015150694 | 8/2015 |
| JP | 2015182349 | 10/2015 |

OTHER PUBLICATIONS

"Search report of European Counterpart Application," dated Aug. 14, 2017, p. 1-p. 8, in which the listed references were cited.

*Primary Examiner* — Sharon A Polk
(74) *Attorney, Agent, or Firm* — JCIPRNET

(57) ABSTRACT

An image-forming device includes a printing portion that forms images on the media being transported using ink, a varnish application portion that applies aqueous varnish to the media on which the images are formed, a treatment portion that performs a treatment on the media so that a stickiness evaluation value which is a stickiness evaluation value indicating a degree of stickiness of the aqueous varnish applied to the media when the media to which the aqueous varnish is applied are output from the varnish application portion and is derived using a damped vibration percentage of a pendulum caused to do pendulum motions from an arbitrary location of the media to which the aqueous varnish is applied as a pivot reaches 0.24 or less, and an accumulation portion that accumulates the media to which the aqueous varnish is applied and on which the treatment is performed.

14 Claims, 18 Drawing Sheets

(56) References Cited

U.S. PATENT DOCUMENTS

| | | | | |
|---|---|---|---|---|
| 2016/0177116 | A1* | 6/2016 | Katsuragi | C09D 11/324<br>347/102 |
| 2016/0264807 | A1* | 9/2016 | Sagara | C09D 11/322 |

* cited by examiner

FIG. 11

| TEST No. | DEVICE FORMAT | FILM SURFACE TEMPERATURE AFTER INK DRYING TREATMENT | PAPER EJECTION TEMPERATURE | REACHED FILM SURFACE TEMPERATURE AND HEATING PERIOD DURING VARNISH APPLICATION | PERIOD FROM THE END OF INK DRYING TREATMENT THROUGH THE BEGINNING OF VARNISH APPLICATION | AMOUNT OF POWDER SPRAYED | STICKNESS EVALUATION VALUE (LOGARITHM DAMPING PERCENTAGE) | BLOCKING PERFORMANCE |
|---|---|---|---|---|---|---|---|---|
| | | [°C] | [°C] | [°C]/[SECOND] | [MINUTES] | [GRAMS/SHEET] | | |
| 1 | OFFLINE | 70 | 50 | | 1 | 0 | 0.43 | D |
| 2 | OFFLINE | 70 | 50 | | 3 | 0 | 0.26 | D |
| 3 | OFFLINE | 70 | 50 | | 5 | 0 | 0.20 | C |
| 4 | OFFLINE | 70 | 50 | | 10 | 0 | 0.18 | A |
| 5 | OFFLINE | 70 | 50 | | 15 | 0 | 0.17 | A |
| 6 | OFFLINE | 70 | 50 | | 30 | 0 | 0.15 | A |
| 7 | OFFLINE | 70 | 50 | | 60 | 0 | 0.11 | A |

FIG. 12

| TEST No. | DEVICE FORMAT | FILM SURFACE TEMPERATURE AFTER INK DRYING TREATMENT | PAPER EJECTION TEMPERATURE | REACHED FILM SURFACE TEMPERATURE AND HEATING PERIOD DURING VARNISH APPLICATION | PERIOD FROM THE END OF INK DRYING TREATMENT THROUGH THE BEGINNING OF VARNISH APPLICATION | AMOUNT OF POWDER SPRAYED | STICKNESS EVALUATION VALUE (LOGARITHM DAMPING PERCENTAGE) | BLOCKING PERFORMANCE |
|---|---|---|---|---|---|---|---|---|
| | | [°C] | [°C] | [°C]/[SECOND] | [MINUTES] | [GRAMS/SHEET] | | |
| 11 | ONLINE | 70 | 50 | 60/1 | 1.2 | 0 | 0.36 | D |
| 12 | ONLINE | 70 | 50 | 133/2 | 1.2 | 0 | 0.20 | C |
| 13 | ONLINE | 70 | 50 | 170/3 | 1.2 | 0 | 0.11 | A |
| 14 | ONLINE | 70 | 50 | 215/5 | 1.2 | 0 | 0.04 | A |
| 15 | ONLINE | 70 | 50 | 35/5 | 1.2 | 0 | 0.24 | C |
| 16 | ONLINE | 70 | 50 | 85/5 | 1.2 | 0 | 0.18 | A |
| 17 | ONLINE | 70 | 50 | 135/5 | 1.2 | 0 | 0.09 | A |
| 18 | ONLINE | 70 | 50 | 170/5 | 1.2 | 0 | 0.07 | A |
| 19 | ONLINE | 70 | 50 | 50/15 | 1.6 | 0 | 0.39 | D |
| 20 | ONLINE | 70 | 50 | 50/60 | 2.4 | 0 | 0.24 | C |
| 21 | ONLINE | 70 | 50 | 50/90 | 2.9 | 0 | 0.18 | A |
| 22 | ONLINE | 70 | 50 | 50/120 | 3.4 | 0 | 0.16 | A |
| 23 | ONLINE | 70 | 50 | 60/5 | 1.8 | 0 | 0.23 | C |
| 24 | ONLINE | 70 | 50 | 60/10 | 1.9 | 0 | 0.13 | A |
| 25 | ONLINE | 70 | 50 | 60/15 | 2.0 | 0 | 0.12 | A |

FIG. 13

| TEST No. | DEVICE FORMAT | FILM SURFACE TEMPERATURE AFTER INK DRYING TREATMENT | PAPER EJECTION TEMPERATURE | REACHED FILM SURFACE TEMPERATURE AND HEATING PERIOD DURING VARNISH APPLICATION | PERIOD FROM THE END OF INK DRYING TREATMENT THROUGH THE BEGINNING OF VARNISH APPLICATION | AMOUNT OF POWDER SPRAYED | STICKNESS EVALUATION VALUE (LOGARITHM DAMPING PERCENTAGE) | BLOCKING PERFORMANCE |
|---|---|---|---|---|---|---|---|---|
| | | [°C] | [°C] | [°C]/[SECOND] | [MINUTES] | [GRAMS/SHEET] | | |
| 31 | INLINE | 90 | 45 | | <0.1 | 0 | 0.29 | D |
| 32 | INLINE | 90 | 40 | | <0.1 | 0 | 0.24 | C |
| 33 | INLINE | 90 | 35 | | <0.1 | 0 | 0.19 | B |
| 34 | INLINE | 90 | 30 | | <0.1 | 0 | 0.18 | A |
| 35 | INLINE | 90 | 35 | | <0.1 | 0 | 0.18 | B |
| 36 | INLINE | 90 | 30 | | <0.1 | 0 | 0.16 | A |
| 37 | INLINE | 90 | 45 | | <0.1 | 0 | 0.24 | C |
| 38 | INLINE | 101 | 44 | | <0.1 | 0 | 0.19 | B |
| 39 | INLINE | 120 | 45 | | <0.1 | 0 | 0.15 | A |
| 40 | INLINE | 90 | 45 | | <0.1 | 0.01 | 0.21 | C |
| 41 | INLINE | 90 | 45 | | <0.1 | 0.02 | 0.12 | A |
| 42 | INLINE | 90 | 45 | | <0.1 | 0.04 | 0.09 | A |

FIG. 14

| SOLVENT NAME | SP VALUE | MOLECULAR WEIGHT | STRUCTURE |
|---|---|---|---|
| GLYCERIN | 33.52 | 92.09 | 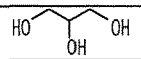 |
| DIGLYCERIN S (TRADE NAME) | 31.51 | 166 | 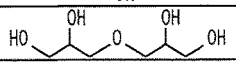 |
| POLYGYLCERIN 310 (TRADE NAME) | | 310 | 4 TETRAMER |
| SCE-750 (TRADE NAME) | 23.65 | 750 | 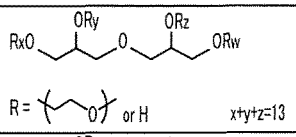 |
| SCP-750 (TRADE NAME) | 22.67 | 750 | 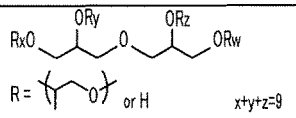 |
| SCP-400 (TRADE NAME) | 26.09 | 400 | 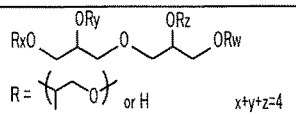 |
| SCE-450 (TRADE NAME) | 26.63 | 450 | 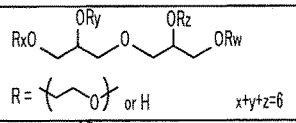 |
| GP-250 (TRADE NAME) | 26.38 | 250 | 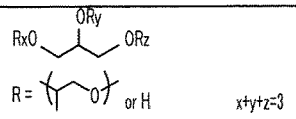 |
| DEG (DIETHYLENE GLYCOL) | 30.62 | 106 | 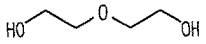 |
| TEG (TRIETHYLENE GLYCOL) | 27.79 | 150 | 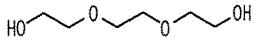 |
| TEG (TETRAETHYLENE GLYCOL) | 26.1 | 200 | 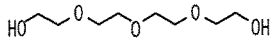 |
| DPG (DIPROPYLENE GLYCOL) | 27.14 | 134.17 | 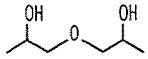 |
| PP-200 (TRIPROPYLENE GLYCOL) | 24.67 | 200 | 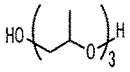 |
| DPGmME (DIPROPYLENE GLYCOL MONOMETHYL ETHER) | 21.31 | 148.12 | 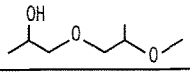 |
| TEGmEE (TRIETHYLENE GLYCOL MONOETHYL ETHER) | 21.73 | 178.13 | 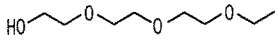 |
| TEGmBE (TRIETHYLENE GLYCOL MONOBUTYL ETHER) | 21.11 | 206.28 | 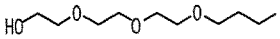 |
| TPGmME (TRIPROPYLENE GLYCOL MONOMETHYL ETHER) | 20.43 | 206 | 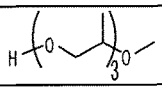 |

FIG. 15

| SOLVENT NAME | SP VALUE | MOLECULAR WEIGHT | STRUCTURE |
|---|---|---|---|
| DEGmEE(DIETHYLENE GLYCOL MONOETHYL ETHER) | 22.38 | 134.17 | 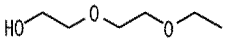 |
| DEGmBE(DIETHYLENE GLYCOL MONOBUTYL ETHER) | 21.51 | 162.23 | 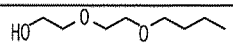 |
| TEGmME(TRIETHYLENE GLYCOL MONOMETHYL ETHER) | 22.13 | 164.2 | 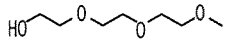 |
| 50HB-55(TRADE NAME) | 20.11 | 278.38 | 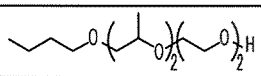 |
| UNIOX G1200 (TRADE NAME) | 21.16 | 1237.5 | 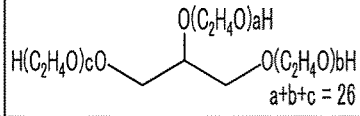  |
| UNIROOF 50TG-32 (TRADE NAME) | 19.32 | 2543.3 | 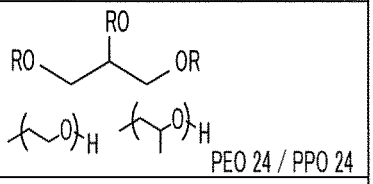  |
| 1,3-BDO (1,3-BUTANEDIOL) | 30.27 | 90.12 | 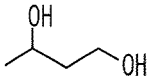 |
| 1,5-PDO (1,5-PENTANEDIOL) | 28.96 | 104.1 | 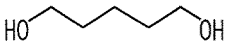 |
| 1,2-HDO (1,2-MOHEXANEDIOL) | 24.14 | 118 | 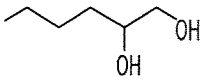 |
| PG (PROPYLENE GLYCOL) | 32.55 | 76 | 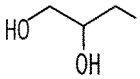 |
| EG (ETHYLENE GLYCOL) | 36.48 | 62 | 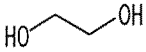 |
| UREA | 38.51 | 60 | 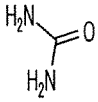 |
| TMP (TRIMETHYLOLPROPANE) | 32.57 | 134.17 | 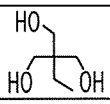 |
| MARKBIOBRIDE MG-10E (TRADE NAME) | 25.1 | 620.7 | 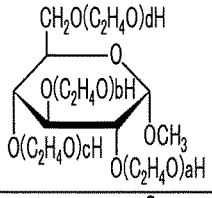  |
| 2-PYRROLIDONE | 25.85 | 85.1 | 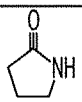 |

FIG. 16

| TEST No. | STICKNESS EVALUATION VALUE (LOGARITHM DAMPING PERCENTAGE) | BLOCKING PERFORMANCE |
|---|---|---|
| 101 | 0.45 | D |
| 102 | 0.28 | D |
| 103 | 0.22 | C |
| 104 | 0.19 | B |
| 105 | 0.17 | A |
| 106 | 0.15 | A |
| 107 | 0.13 | A |

FIG. 17

| TEST No. | STICKNESS EVALUATION VALUE (LOGARITHM DAMPING PERCENTAGE) | BLOCKING PERFORMANCE |
|---|---|---|
| 111 | 0.42 | D |
| 112 | 0.22 | C |
| 113 | 0.12 | A |
| 114 | 0.04 | A |
| 115 | 0.24 | C |
| 116 | 0.19 | B |
| 117 | 0.12 | A |
| 118 | 0.1 | A |
| 119 | 0.45 | D |
| 120 | 0.24 | C |
| 121 | 0.18 | B |
| 122 | 0.17 | A |
| 123 | 0.24 | C |
| 124 | 0.15 | A |
| 125 | 0.12 | A |

FIG. 18

| TEST No. | STICKNESS EVALUATION VALUE (LOGARITHM DAMPING PERCENTAGE) | BLOCKING PERFORMANCE |
|---|---|---|
| 131 | 0.33 | D |
| 132 | 0.24 | C |
| 133 | 0.19 | B |
| 134 | 0.19 | B |
| 135 | 0.18 | B |
| 136 | 0.16 | A |
| 137 | 0.24 | C |
| 138 | 0.19 | B |
| 139 | 0.17 | A |
| 140 | 0.21 | C |
| 141 | 0.14 | A |
| 142 | 0.11 | A |

FIG. 19

| TEST No. | DEVICE FORMAT | INK SOLVENT | CONTENT PERCENTAGE | SP VALUE | MOLECULAR WEIGHT | STICKNESS EVALUATION VALUE (LOGARITHM DAMPING PERCENTAGE) | BLOCKING PERFORMANCE |
|---|---|---|---|---|---|---|---|
| | | [°C] | MASS% | $[(MPa)^{1/2}]$ | | | |
| 33 | INLINE | PG | 14.5 | 32.55 | 76 | 0.19 | B |

FIG. 20

| TEST No. | DEVICE FORMAT | INK SOLVENT | CONTENT PERCENTAGE | SP VALUE | MOLECULAR WEIGHT | STICKNESS EVALUATION VALUE (LOGARITHM DAMPING PERCENTAGE) | BLOCKING PERFORMANCE |
|---|---|---|---|---|---|---|---|
| | | [°C] | MASS% | $[(MPa)^{1/2}]$ | | | |
| 51 | INLINE | EG | 14.5 | 36.48 | 62 | 0.16 | A |
| 52 | INLINE | 1.3-BDO | 14.5 | 30.27 | 90.12 | 0.18 | B |
| 53 | INLINE | 2-PYRROLIDONE | 14.5 | 25.85 | 85.1 | 0.19 | B |
| 54 | INLINE | GP-250 | 14.5 | 26.38 | 250 | 0.24 | C |
| 55 | INLINE | DEG | 14.5 | 30.62 | 106 | 0.2 | C |
| 56 | INLINE | DPG | 14.5 | 27.14 | 134.17 | 0.21 | C |
| 57 | INLINE | DEGmBE | 14.5 | 21.51 | 162.23 | 0.28 | D |
| 58 | INLINE | TPGmME | 14.5 | 20.43 | 206 | 0.33 | D |

IMAGE-FORMING DEVICE AND METHOD FOR APPLYING VARNISH

CROSS-REFERENCE TO RELATED APPLICATIONS

The present application claims priority under 35 U.S.C. § 119 to Japanese Patent Application No. 2016-117234, filed on Jun. 13, 2016. The above application is hereby expressly incorporated by reference, in its entirety, into the present application.

BACKGROUND OF THE INVENTION

1. Field of the Invention

The present invention relates to an image-forming device and a method for applying varnish and particularly to a technique for improving blocking after application of varnish.

2. Description of the Related Art

For the purpose of improving the rub resistance of an image, the resistance of an image to organic solvents, and adhesiveness between an image and a medium, image-forming devices in which a protective layer is formed on a medium on which an image is formed are known.

JP2015-182349A describes an image-forming device in which a protective layer is formed on images using clear ink. In the image-forming device described in JP2015-182349A, heating and air blowing are used after the formation of images and before the formation of protective layers, and the flow of ink forming images is suppressed, thereby preventing the generation of stickiness.

In addition, in the image-forming device described in JP2015-182349A, after protective layers are formed on images, a heating treatment is carried out on the images and the protective layers, thereby improving adhesiveness between the images and the protective layers and adhesiveness between the image and a medium.

Meanwhile, the term 'medium' in the present specification corresponds to the recording medium of JP2015-182349A. The term 'image-forming devices' in the present specification correspond to the ink jet recording device of JP2015-182349A.

JP2015-150694A describes a method for recording images in which clear ink is applied onto a recording medium and the clear ink is heated and dried, thereby causing the viscosity of the clear ink to fall into a predetermined range and ink is applied in this state, thereby forming images on the recording medium.

In the method for recording images of JP2015-150694A, it is possible to obtain images to which ink is highly fixable and in which a granular feeling is suppressed on a poorly-permeable medium or a non-permeable medium. Meanwhile, the term 'media' in the present specification correspond to the recording media of JP2015-150694A.

SUMMARY OF THE INVENTION

However, in a case in which protective layers for which aqueous varnish is used are formed, when media to which aqueous varnish is applied are loaded together, blocking may occur in some cases. Blocking refers to a phenomenon in which, in a case in which media are loaded together, the media adhere to each other. Blocking significantly appears in the case of online-type varnish application in which a varnish application portion is disposed at the rear end of an image-forming portion or in the case of inline-type varnish application in which a varnish application portion is disposed at the rear end of an image-forming portion in a directly connected manner.

The invention described in JP2015-182349A has an object of improving adhesiveness between images and protective layers and adhesiveness between images and media and does not intend to suppress stickiness on the surface of media.

The invention described in JP2015-150694A is to determine the viscosity range of clear ink in order to suppress the granular feeling of protective layers and does not intend to suppress stickiness of protective layers by paying attention to stickiness of the protective layers.

The present invention has been made in consideration of the above-described circumstances, and an object of the present invention is to provide an image-forming device in which the occurrence of blocking is suppressed in media to which aqueous varnish is applied and a method for applying varnish.

In order to achieve the above-described object, the following invention aspects are provided.

An image-forming device of a first aspect is an image-forming device, comprising: a medium transport portion that transports media in a medium transport direction; a printing portion that forms images on the media being transported using ink; a varnish application portion that applies aqueous varnish to the media on which the images are formed; a treatment portion that carries out a treatment on the media so that a stickiness evaluation value reaches 0.24 or less which is the stickiness evaluation value indicating a degree of stickiness of the aqueous varnish applied to the media when the media to which the aqueous varnish is applied are output from the varnish application portion and being derived using a damped vibration percentage of a pendulum caused to do pendulum motions from an arbitrary location of the media to which the aqueous varnish is applied as a pivot; and an accumulation portion that accumulates the media to which the aqueous varnish is applied using the varnish application portion and on which the treatment is carried out using the treatment portion.

According to the first aspect, when the stickiness evaluation value representing stickiness which is a surface property of the aqueous varnish is set to 0.24 or less, it is possible to suppress the occurrence of blocking.

In a second aspect, the treatment portion may have a configuration in which a treatment is carried out on the media so that the stickiness evaluation value reaches less than 0.20.

According to the second aspect, blocking occurring in a case in which the media to which the aqueous varnish is applied are loaded together is further improved, and it is possible to relatively increase the number of media being loaded. In addition, it is possible to relatively increase the amount of ink being used for a single medium.

A third aspect is the image-forming device of the first or second aspect, further comprising: a first temperature detection portion which is disposed at a location on a downstream side of the printing portion in the medium transport direction and at a location on an upstream side of the varnish application portion in the medium transport direction and detects temperatures of the media on which the images are formed using the printing portion and the aqueous varnish is to be applied using the varnish application portion, in which the treatment portion may include a drying treatment portion which is disposed at a location on the downstream side of the printing portion in the medium transport direction and at a location on the upstream side of the varnish application portion in the medium transport direction and carries out a drying treatment on the media on which the images are formed using the printing portion and the aqueous varnish is to be applied using the varnish application portion and a drying treatment control portion that controls temperatures of the media on which the drying treatment is carried out using the drying treatment portion by applying drying conditions under which the stickiness evaluation value of the media to which the aqueous varnish is to be applied using the varnish application portion reaches 0.24 or less.

According to the third aspect, it is possible to control the stickiness of the aqueous varnish being applied using the varnish application portion by appropriately setting the drying treatment conditions of ink.

A fourth aspect is the image-forming device of the third aspect, in which the drying treatment control portion may control the operation of the drying treatment portion by applying drying conditions under which the temperatures of the media which are detected using the first temperature detection portion reach 101° C. or higher.

According to the fourth aspect, the drying treatment of ink is intensified, and the temperatures of the media become relatively high temperatures, whereby the permeation of solvents in the ink into the media, which is a cause of the stickiness of the varnish, is accelerated or the volatilization of the solvents in the ink is accelerated.

A fifth aspect is the image-forming device of the third or fourth aspect, further comprising: a second temperature detection portion which is disposed at a location on the downstream side of the varnish application portion in the medium transport direction and at a location on the upstream side of the accumulation portion in the medium transport direction and detects temperatures of the media on which the aqueous varnish is applied using the varnish application portion and which are to be accumulated in the accumulation portion, in which the treatment portion may include a cooling treatment portion which is disposed at a location on the downstream side of the varnish application portion in the medium transport direction and at a location on the upstream side of the accumulation portion in the medium transport direction and carries out a cooling treatment on the media to which the varnish is applied using the varnish application portion and a cooling treatment control portion that controls temperatures of the media on which the cooling treatment is carried out using the cooling treatment portion by applying cooling conditions under which the stickiness evaluation value of the media to which the aqueous varnish is to be applied using the varnish application portion reaches less than 0.24.

According to the fifth aspect, it is possible to control the stickiness of the aqueous varnish being applied using the varnish application portion by appropriately setting the cooling conditions of the aqueous varnish.

A sixth aspect is the image-forming device of the fifth aspect, in which the cooling treatment control portion may control the operation of the cooling treatment portion by applying cooling conditions under which the temperatures of the media which are detected using the second temperature detection portion reach 40° C. or lower.

According to the sixth aspect, since blocking between the media being loaded together occurs when the media adhere to each other, it is possible to suppress the occurrence of blocking between the media being loaded by setting the temperatures of the media being transported to the accumulation portion after the cooling treatment to temperatures at which blocking does not easily occur.

A seventh aspect is the image-forming device of the first or second aspect, in which the treatment portion may include a transfer treatment portion that transfers the media on which the images are formed using the printing portion and to which the varnish is to be applied in the varnish application portion and a transfer condition setting portion that sets conditions under which an environment temperature is 15° C. or higher and 35° C. or lower, an environmental relative humidity is 35 percent or higher and 65 percent or lower, and a transfer period is ten minutes or longer as transfer conditions in the transfer treatment portion.

According to the seventh aspect, when the media on which the images are formed in the transfer treatment portion are transferred, it is possible to permeate the solvents in the ink forming the images into the media, the mixing of the solvents in the ink into the aqueous varnish during the application of the aqueous varnish to the media is suppressed, and the stickiness of the aqueous varnish is suppressed.

As the environment temperature in the seventh aspect, 20° C. or higher and 30° C. or lower is applicable. As the environmental humidity in the seventh aspect, an environmental relative humidity of 40 percent or higher and 60 percent or lower is applicable.

An eighth aspect is the image-forming device of the first or second aspect, in which the treatment portion may include a transfer treatment portion that transfers the media on which the images are formed using the printing portion and to which the varnish is to be applied in the varnish application portion and a transfer condition setting portion that sets conditions under which an environment temperature is 50° C. or higher and a transfer period is 90 seconds or longer as transfer conditions in the transfer treatment portion.

According to the eighth aspect, when the viscosity of the solvents in the ink in the media is decreased, the mixing of the solvents in the ink into the aqueous varnish during the application of the aqueous varnish to the media is suppressed, and the stickiness of the aqueous varnish is suppressed.

A ninth aspect is the image-forming device of the first or second aspect, in which the treatment portion may include a transfer treatment portion that transfers the media on which the images are formed using the printing portion and to which the varnish is to be applied in the varnish application portion and a transfer condition setting portion that sets conditions under which an environment temperature is 60° C. or higher and a transfer period is ten seconds or longer as transfer conditions in the transfer treatment portion.

According to the ninth aspect, when the viscosity of the solvents in the ink in the media is decreased, the mixing of the solvents in the ink into the aqueous varnish during the application of the aqueous varnish to the media is suppressed, and the stickiness of the aqueous varnish is suppressed.

A tenth aspect is the image-forming device of the third or fourth aspect, in which the treatment portion may include a powder spraying portion that sprays powder to the media treated using the treatment portion and a powder spraying control portion that sprays powder to the media treated using the treatment portion using the powder spraying portion in a case in which the temperatures of the media detected using the first temperature detection portion are lower than 101° C.

According to the tenth aspect, even in a case in which the temperatures of the media after the treatment are lower than 101° C., the occurrence of blocking between the media being loaded in a loading portion is suppressed.

In the tenth aspect, in a case in which the powder is sprayed even when the temperatures of the media detected using the first temperature detection portion are 101° C. or higher and a case in which the temperatures of the media detected using the first temperature detection portion are lower than 101° C., the amount of the powder sprayed may be increased more than in a case in which the temperatures of the media detected using the first temperature detection portion are 101° C. or higher.

An eleventh aspect is the image-forming device of the fifth or sixth aspect, in which the treatment portion may include a powder spraying portion that sprays powder to the media treated using the treatment portion and a powder spraying control portion that sprays powder to the media treated using the treatment portion using the powder spraying portion in a case in which the temperatures of the media detected using the second temperature detection portion exceeds 40° C.

According to the eleventh aspect, even in a case in which the temperatures of the media after the treatment exceed 40° C., the occurrence of blocking between the media being loaded in the loading portion is suppressed.

In the eleventh aspect, in a case in which the powder is sprayed even when the temperatures of the media detected using the second temperature detection portion are 40° C. or lower and a case in which the temperatures of the media detected using the second temperature detection portion exceed 40° C., the amount of the powder sprayed may be increased more than in a case in which the temperatures of the media detected using the second temperature detection portion are 40° C. or lower.

A twelfth aspect is the image-forming device of any one of the first to eleventh aspects, in which the ink may contain a solvent having an SP value of 25 $(MPa)^{1/2}$ or more.

According to the twelfth aspect, when a hydrophilic solvent is used in the ink, the mixing of the solvents in the ink into the aqueous varnish applied to the media is suppressed, and the stickiness of the aqueous varnish is suppressed.

A thirteenth aspect is the image-forming device of any one of the first to twelfth aspects, in which the ink may contain a solvent having a molecular weight of 100 or less.

According to the thirteenth aspect, since solvents having a relatively low molecular weight of 100 or less easily escape from films of the ink configuring the images formed on the media, the mixing of the solvents in the ink into the aqueous varnish applied to the media is suppressed, and the stickiness of the aqueous varnish is suppressed.

A method for applying varnish of a fourteenth aspect is a method for applying varnish, comprising: a printing step of forming images on media using ink; a varnish application step of applying aqueous varnish to the media on which images are formed using the printing step using a varnish application portion; a treatment step of carrying out a treatment on the media so that a stickiness evaluation value reaches 0.24 or less which is the stickiness evaluation value indicating a degree of stickiness of the aqueous varnish applied to the media when the media to which the aqueous varnish is applied in the varnish application step are output from the varnish application portion and being derived using a damped vibration percentage of a pendulum caused to do pendulum motions from an arbitrary location of the media to which the aqueous varnish is applied as a pivot; and an accumulation step of accumulating the media to which the aqueous varnish is applied in the varnish application step and on which the treatment is carried out in the treatment step.

According to the fourteenth aspect, it is possible to obtain the same effects as in the first aspect.

In the fourteenth aspect, it is possible to appropriately combine the same matters as the matters specified in the second to thirteenth aspects. In this case, configuration elements assuming the treatments or functions specified in the image-forming device can be understood as configuration elements of the method for applying varnish which assume treatments or functions that correspond thereto.

According to the present invention, the occurrence of blocking can be suppressed by setting the stickiness evaluation value representing stickiness which is a surface property of aqueous varnish and indicates stickiness to 0.24 or less.

BRIEF DESCRIPTION OF THE DRAWINGS

FIG. 11 is a table showing the evaluation results of stickiness evaluation in the offline-type varnish application.

FIG. 12 is a table showing the evaluation results of stickiness evaluation in the online-type varnish application.

FIG. 13 is a table showing the evaluation results of stickiness evaluation in the inline-type varnish application.

FIG. 14 is an explanatory view illustrating an example of a solvent being used in ink.

FIG. 15 is an explanatory view illustrating an example of the solvent being used in the ink.

FIG. 16 is a table showing the evaluation results of stickiness evaluation in the offline-type varnish application in a case in which the kind of the varnish is changed.

FIG. 17 is a table showing the evaluation results of stickiness evaluation in the online-type varnish application in a case in which the kind of the varnish is changed.

FIG. 18 is a table showing the evaluation results of stickiness evaluation in the inline-type varnish application in a case in which the kind of the varnish is changed.

FIG. 19 is a table showing the kind of a solvent in ink, the content of the solvent in the ink, the SP value of the solvent in the ink, and the molecular weight of the solvent in the ink in Test 33 of FIG. 13.

FIG. 20 is a table showing the evaluation results of stickiness evaluation in the varnish application in cases in which the solvent in the ink is changed in Test 33 of FIG. 13.

DESCRIPTION OF THE PREFERRED EMBODIMENTS

Hereinafter, preferred embodiments will be described in detail according to the accompanying drawings. In the present specification, configurations described previously will be given the same reference signal and will not be appropriately described.

[Description of Image-Forming Device]

<Overall Configuration>

Figure 1:
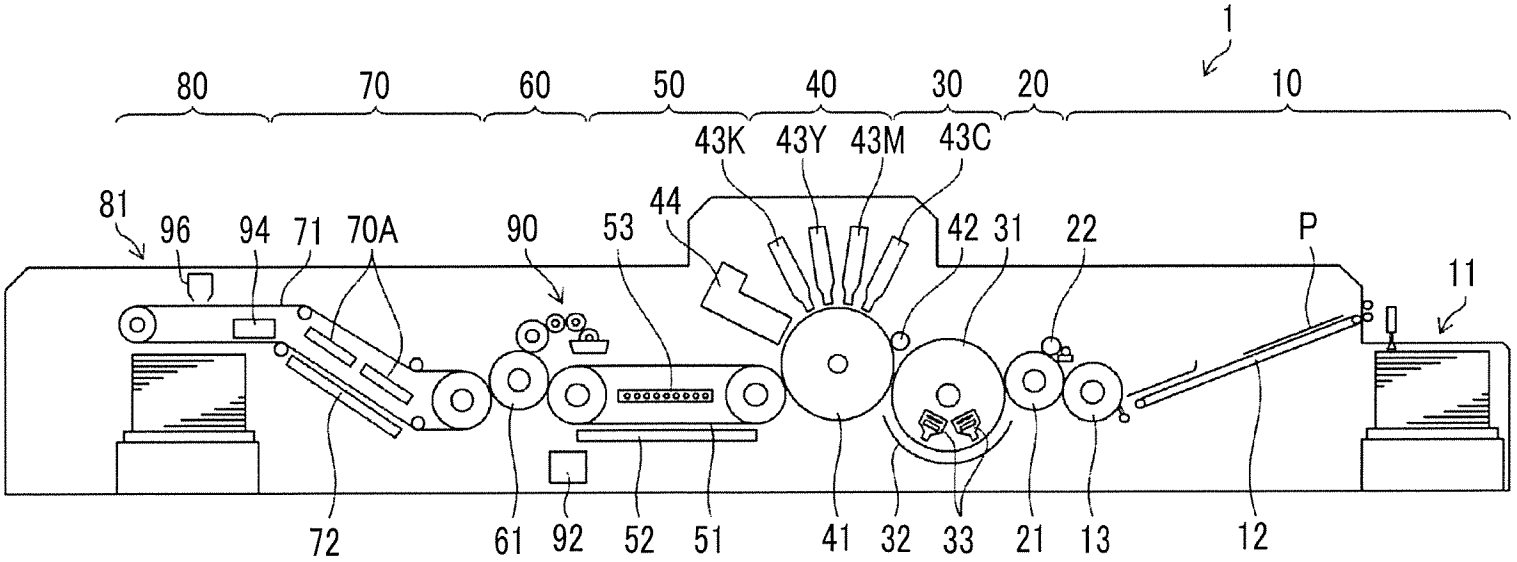
FIG. 1 is an overall configuration diagram of an image-forming device.

FIG. 1 is an overall configuration diagram of an image-forming device. An ink jet printing device 1 illustrated in FIG. 1 is configured as a printing device capable of coating printing subjects with varnish inline.

The ink jet printing device 1 includes a paper feeding portion 10, a treatment liquid application portion 20, a treatment liquid drying portion 30, a printing portion 40, an ink drying portion 50, a varnish application portion 60, a varnish post treatment portion 70, and an accumulation portion 80.

In addition, the ink jet printing device 1 illustrated in FIG. 1 includes a first temperature detection portion 92, a second temperature detection portion 94, and a powder spraying portion 96. Hereinafter, the respective portions of the ink jet printing device 1 will be described in detail.

<Paper Feeding Portion>

The paper feeding portion 10 feeds paper P which is flat paper sheet by sheet. As illustrated in FIG. 1, the paper feeding portion 10 includes a paper feeding device 11, a feeder board 12, and a paper feeding drum 13. The paper P is an aspect of media.

The paper feeding device 11 feeds the paper P sheet by sheet. The paper P is set on a paper feeding platform in a paper bundle state and is sequentially fed from the top at certain intervals.

The feeder board 12 receives the paper P fed from the paper feeding device 11, transports the received paper P along a certain transport path, and delivers the paper to the paper feeding drum 13.

The paper feeding drum 13 receives the paper P from the feeder board 12, transports the received paper P along a certain transport path, and delivers the paper to the treatment liquid application drum 21. The paper feeding drum 13 grips the front end of the paper P with a gripper provided on the circumferential surface and rotates, thereby transporting the paper P in a state of being wound around the circumferential surface. Meanwhile, the gripper is not illustrated in the drawings.

<Treatment Liquid Application Portion>

The treatment liquid application portion 20 applies a treatment liquid to a printing surface of the paper P. The treatment liquid is a liquid having a function of agglomerating color material components in ink or a function of preventing the color material components in the ink from being dissolved. When printing is carried out on the paper P to which the treatment liquid is applied, it becomes possible to print high-quality images even in a case in which ordinary printing paper is used.

As illustrated in FIG. 1, the treatment liquid application portion 20 includes a treatment liquid application drum 21 that transports the paper p along a certain transport path and a treatment liquid application device 22 that applies the treatment liquid to the paper P.

The treatment liquid application drum 21 receives the paper P from the paper feeding drum 13, transports the received paper P along a certain transport path, and delivers the paper to a treatment liquid drying drum 31. The treatment liquid application drum 21 grips the front end of the paper P with a gripper provided on the circumferential surface and rotates, thereby transporting the paper P in a state of being wound around the circumferential surface. Meanwhile, the gripper is not illustrated in the drawings.

The treatment liquid application device 22 applies the treatment liquid to the printing surface of the paper P being transported using the treatment liquid application drum 21. The printing surface of the paper P is a surface of the paper P opposite to the surface supported using the treatment liquid application drum 21.

The treatment liquid application device 22 applies the treatment liquid using an application roller. That is, the treatment liquid application device 22 presses the application roller supplied with the treatment liquid on the circumferential surface onto the printing surface of the paper P and applies the treatment liquid to the paper P. Meanwhile, the role of the treatment liquid application device 22 is not limited to the application of the treatment liquid, and additionally, it is also possible to apply the treatment liquid in an ink jet mode, a spray mode, or the like.

The treatment liquid application portion 20 is configured as described above. In a process of transporting the paper P using the treatment liquid application drum 21, the treatment liquid is applied onto the printing surface using the treatment liquid application device 22.

<Treatment Liquid Drying Portion>

The treatment liquid drying portion 30 dries the treatment liquid applied to the paper P. The treatment liquid drying portion 30 illustrated in FIG. 1 includes a treatment liquid drying drum 31 that transports the paper P along a certain transport path, a first paper guide 32 that guides the transport of the paper P, and a dryer 33 that blows hot air toward the paper P.

The treatment liquid drying drum 31 receives the paper P from the treatment liquid application drum 21, transports the received paper P along a certain transport path, and delivers the paper to a printing drum 41. The treatment liquid drying drum 31 grips the front end of the paper P with a gripper provided on the circumferential surface and rotates, thereby transporting the paper P along a certain transport path. Meanwhile, the gripper is not illustrated in the drawings.

The first paper guide 32 is disposed along the transport path of the paper P by the treatment liquid drying drum 31 and guides the transport of the paper P. The paper P is transported while being slid on the first paper guide 32.

The dryer 33 blows hot air to the printing surface of the paper P being transported using the treatment liquid drying drum 31 so as to heat the printing surface of the paper P to which the treatment liquid is applied. In order to heat the printing surface, the dryer 33 is disposed inside the treatment liquid drying drum 31.

The dryer 33 is configured by including a heat source such as a halogen heater or an IR heater and air blowing means such as a fan or a blower that blows the air swollen using the heat source. Meanwhile, IR is the abbreviation of 'infrared' which indicates infrared rays.

In a case in which the dryer 33 is configured using a heater and a fan, the heating intensity can be adjusted by adjusting at least any one of the number of times of lighting of the heater or the lighting duty ratio of the heater.

The treatment liquid drying portion 30 is configured as described above. In a process of transporting the paper P using the treatment liquid drying drum 31, hot air is blown to the printing surface from the dryer 33. Therefore, the printing surface is heated, and solvent components in the treatment liquid applied to the printing surface are dried and removed.

<Printing Portion>

The printing portion 40 prints images on the printing surface of the paper P by applying an ink jet mode. In the present specification, the term 'printing' is equivalent to the term 'image formation'.

The printing portion 40 illustrated in FIG. 1 includes the printing drum 41 that transports the paper P along a certain transport path, a paper pressing roller 42, an ink jet head 43C that ejects liquid droplets of cyan ink to the paper P, an ink jet head 43M that ejects liquid droplets of magenta ink to the paper P, an ink jet head 43Y that ejects liquid droplets of yellow ink to the paper P, an ink jet head 43K that ejects liquid droplets of black ink to the paper P, and a scanner 44 that scans the images printed on the paper P.

In FIG. 1, alphabets attached to the reference sign 43 indicating the ink jet heads represent the color of ink. C represents cyan, M represents magenta, Y represents yellow, and K represents black.

The printing drum 41 receives the paper P from the treatment liquid drying drum 31, transports the received paper P along a certain transport path, and delivers the paper to a first chain delivery 51. The printing drum 41 grips the front end of the paper P with a gripper provided on the circumferential surface and rotates, thereby transporting the paper P in a state of being wound around the circumferential surface. Meanwhile, the gripper is not illustrated in the drawings.

The paper pressing roller 42 presses the paper P onto the circumferential of the printing drum 41 and adheres the paper to the circumferential of the printing drum 41.

The ink jet head 43C, the ink jet head 43M, the ink jet head 43Y, and the ink jet head 43K eject ink liquid droplets toward the printing surface of the paper P being transported using the printing drum 41 and print images.

The ink jet head 43C, the ink jet head 43M, the ink jet head 43Y, and the ink jet head 43K are line heads capable of printing a single sheet of the paper P in a single pass.

The line head is an ink jet head in which nozzle portions included in the ink jet head 43C, the ink jet head 43M, the ink jet head 43Y, and the ink jet head 43K are disposed in the transport direction of the paper P across a length that is equal to or longer than the entire length of the paper P.

Meanwhile, the nozzle portions are not illustrated in the drawings. Configuration examples of the nozzle portion include configurations in which nozzle openings formed on the ejection surfaces of the ink jet head 43C, the ink jet head 43M, the ink jet head 43Y, and the ink jet head 43K, a communication flow path that is communicated with the nozzle openings, a pressure chamber that is communicated with the nozzle flow path, and a pressurization element that pressurizes ink stored in the pressure chamber are provided. As the pressurization element, piezoelectric elements or heating elements are applicable.

The ink jet head 43C, the ink jet head 43M, the ink jet head 43Y, and the ink jet head 43K are disposed on the transport path of the paper P by the printing drum 41 at certain intervals.

The ink jet head 43C, the ink jet head 43M, the ink jet head 43Y, and the ink jet head 43K are provided with a plurality of the nozzle portions which eject ink droplets.

To the ink jet head 43C, the ink jet head 43M, the ink jet head 43Y, and the ink jet head 43K, it is possible to apply structures in which a plurality of the nozzle portions are matrix-disposed.

The matrix disposition refers to the disposition of the nozzle portions in which the disposition intervals of the nozzle portions in a direction orthogonal to the transport direction of the paper P becomes equal intervals in a projected nozzle portion group obtained by projecting a plurality of the nozzle portions in the direction orthogonal to the transport direction of the paper P.

In the present specification, the term 'orthogonal' or 'perpendicular' also means substantially orthogonal or perpendicular so that even directions intersecting each other at an angle of more than 90 degrees or less than 90 degrees can be considered as directions being substantially orthogonal or perpendicular as long as the same action and effect as in the case of directions intersecting each other at an angle of 90 degrees are exhibited.

In addition, in the present specification, the term "same" also means substantially the same so that even things being different from each other can be considered as things being the same as each other as long as the same action and effect as in the case of things being the same are exhibited.

To the ink jet head 43C, the ink jet head 43M, the ink jet head 43Y, and the ink jet head 43K, it is possible to apply structures in which a plurality of head modules are connected to each other.

The scanner 44 scans the images printed on the printing surface of the paper P being transported using the printing drum 41. The scanner 44 is disposed at a location on the downstream side of the ink jet head 43K which is disposed at the lowest location on the downstream side in the transport direction of the paper P. Meanwhile, the transport direction of the paper P corresponds to a medium transport direction.

The printing portion 40 is configured as described above. In a process of transporting the paper P using the printing drum 41, ink droplets emitted from the ink jet head 43C, the ink jet head 43M, the ink jet head 43Y, and the ink jet head 43K are thrown to the printing surface and color images are recorded on the printing surface. Meanwhile, the scanner 44 scans the printed images as necessary.

<Ink Drying Portion>

The ink drying portion 50 dries the ink by heating the paper P on which images have been printed. The ink drying portion 50 illustrated in FIG. 1 includes the first chain delivery 51 that transports the paper P along a certain transport path, a second paper guide 52 that guides the paper P being transported using the first chain delivery 51, and a first heating device 53 as means for heating the image surface of the paper P being transported using the first chain delivery 51.

The first chain delivery 51 receives the paper P from the printing drum 41, transports the received paper P along a predetermined transport path, and delivers the paper to a varnish application drum 61. The first chain delivery 51 includes a pair of endless chains that run along a certain running path, grips the front end of the paper P using a gripper built over a pair of the chains, and transports the paper P along a certain transport path.

Meanwhile, FIG. 1 illustrates one chain out of a pair of the chains configuring the first chain delivery 51. In addition, the gripper is not illustrated in the drawings.

The second paper guide 52 guides the running of the paper P being transported using the first chain delivery 51. The second paper guide 52 has a hollow board shape and has a guide surface that is flat along the transport path of the paper P.

The paper P is transported while being slid on the guide surface. A plurality of suction holes are formed on the guide surface. The paper P slides on the guide surface while being applied with suction pressure generated in the respective suction holes. Therefore, it is possible to transport the paper P while applying tension to the paper.

The first heating device 53 heats the printing surface of the paper P being transported using the first chain delivery 51 and dries the ink configuring the images. FIG. 1 illustrates, as a configuration example of the first heating device 53, a configuration in which a plurality of rod-shaped heaters are disposed at certain intervals in the transport direction of the paper P.

The respective heaters are disposed in a direction orthogonal to the transport direction of the paper P. Examples of the heater include a halogen heater and an IR heater. The heating intensity of the first heating device 53 can be adjusted by adjusting at least any one of the number of times of lighting of the heater or the lighting duty ratio of the heater.

The ink drying portion 50 is configured as described above. In a process of transporting the paper P using the first chain delivery 51, the printing surface of the paper P is heated using the first heating device 53, and the ink is dried.

The ink drying portion is an aspect of the treatment portion. In addition, the ink drying portion is an aspect of a drying treatment portion that is disposed at a location on the downstream side of the printing portion in the medium transport direction and at a location on the upstream side of the varnish application portion in the medium transport direction.

<Varnish Application Portion>

The varnish application portion 60 applies varnish to the surfaces of the images on the paper P on which the images have been formed. The varnish application portion 60 illustrated in FIG. 1 includes a varnish application drum 61 that transports the paper P along a certain transport path and a varnish coater 90 that applies varnish to the image surfaces on the paper P being transported using the varnish application drum 61.

The varnish application drum 61 receives the paper P from the first chain delivery 51, transports the received paper P along a certain transport path, and delivers the paper to the second chain delivery 71. The varnish application drum 61 grips the front end of the paper P with a gripper provided on the circumferential surface and rotates, thereby transporting the paper P in a state of being wound around the circumferential surface. Meanwhile, the gripper is not illustrated in the drawings.

Configuration examples of the varnish coater 90 include configurations in which a varnish tank, a pumping roller, a measurement blade, a plurality of intermediate transfer rollers, and a varnish application roller are provided.

The varnish application portion 60 is configured as described above. In a case in which the paper P on which the images have been printed is coated with varnish, in a process of transporting the paper P to the varnish application drum 61, the varnish application roller is pressed on and is brought into contact with the printing surface, and the printing surface is coated with varnish. The application of varnish is an aspect of the application of varnish. The varnish application portion is an aspect of the varnish application portion.

<Varnish Post Treatment Portion>

The varnish post treatment portion 70 carries out a post treatment of the varnish applied to the surfaces of the images formed on the paper P using the varnish application portion 60. In a case in which aqueous varnish is used, a heating and drying treatment is carried out on the varnish applied to the surfaces of the images formed on the paper P as the post treatment of the varnish.

The varnish post treatment portion 70 illustrated in FIG. 1 includes a second chain delivery 71 that transports the paper p along a certain transport path, a third paper guide 72 that guides the paper P being transported using the second chain delivery 71, and a second heating device 70A that dries the varnish by heating the surfaces of the images formed on the paper P being transported using the second chain delivery 71.

The second chain delivery 71 receives the paper P from the varnish application drum 61, transports the received paper P along a certain transport path, and ejects the paper at a paper ejection location. The second chain delivery 71 includes a pair of endless chains that run along a certain running path, grips the front end of the paper P using a gripper built over a pair of the chains, and transports the paper P along a certain transport path.

Meanwhile, FIG. 1 illustrates one chain out of a pair of the chains configuring the second chain delivery 71. In addition, the gripper is not illustrated in the drawings.

The third paper guide 72 guides the running of the paper P being transported using the second chain delivery 71. The third paper guide 72 has a hollow board shape and has a guide surface that is flat along the transport path of the paper P.

The paper P is transported while being slid on the guide surface. A plurality of suction holes are formed on the guide surface. The paper P slides on the guide surface while being applied with suction pressure generated in the respective suction holes. Therefore, it is possible to transport the paper P while applying tension to the paper.

The second heating device 70A heats the surfaces of the images formed on the paper P being transported using the second chain delivery 71 and re-dissolves a wax component eccentrically present on the surface of an ink layer into a varnish layer, whereby it is possible to remove the wax component eccentrically present on the surface of the ink layer. Therefore, it is possible to enhance the adhesiveness of varnish.

To the second heating device 70A, it is possible to apply the same configuration as that of the first heating device 53 and apply the same treatment as that in the first heating device 53.

The varnish post treatment portion 70 is configured as described above. In a process of transporting the paper P to which aqueous varnish has been applied using the second chain delivery 71, the surfaces of the images are heated using the second heating device 70A, and the applied varnish is dried.

The varnish post treatment portion 70 may include a cooling treatment portion that cools the varnish applied to the paper P. Configuration examples of the cooling treatment portion include configurations in which a blasting fan is provided. When a cooling treatment is carried out on varnish, it is possible to increase the viscosity of the varnish. When the viscosity of varnish is increased, the mixing of solvents in ink into varnish is suppressed, and it becomes possible to suppress stickiness of varnish.

The varnish post treatment portion is an aspect of the treatment portion. The cooling treatment portion not illustrated is an aspect of the cooling treatment portion being included in the treatment portion. In addition, a control portion of the cooling treatment portion is an aspect of the cooling treatment control portion.

<Accumulation Portion>

The accumulation portion 80 accumulates the paper P being ejected. The accumulation portion 80 is configured by including an accumulation device 81. The accumulation device 81 receives the paper P being released from the second chain delivery 71 at the predetermined paper ejection location, stacks the paper on an ejected paper table, and collects the paper.

<First Temperature Detection Portion>

The first temperature detection portion 92 illustrated in FIG. 1 detects the temperature of the paper P on which a drying treatment has been carried out using the ink drying portion 50. Examples of the temperature of the paper P which is detected using the first temperature detection portion 92 include the surface temperatures of images being formed on the paper P.

The first temperature detection portion 92 illustrated in FIG. 1 is disposed at a location corresponding to the location at which the paper P is ejected from the ink drying portion 50. That is, the first temperature detection portion 92 is disposed at a location at which it is possible to detect the temperature of the paper P on which a drying treatment has been carried out using the ink drying portion 50 and to which varnish is to be applied using the varnish application portion 60. As the first temperature detection portion 92, non-contact-type temperature sensors are applicable.

<Second Temperature Detection Portion>

The second temperature detection portion 94 illustrated in FIG. 1 detects the temperature of the paper P to which varnish has been applied using the varnish application portion 60. Examples of the temperature of the paper P which is detected using the second temperature detection portion 94 include the surface temperature of varnish applied to images being formed on the paper P.

The second temperature detection portion 94 illustrated in FIG. 1 is disposed at a location corresponding to the location at which the paper P is ejected from the varnish post treatment portion 70. That is, the second temperature detection portion 94 is disposed at a location at which it is possible to detect the temperature of the paper P on which a post treatment of varnish has been carried out using the varnish post treatment portion 70 and which is to be accumulated in the accumulation portion 80. As the second temperature detection portion 94, non-contact-type temperature sensors are applicable.

<Powder Spraying Portion>

The powder spraying portion 96 sprays powder to the paper P which is to be accumulated in the accumulation portion 80. The powder spraying portion 96 illustrated in FIG. 1 is disposed at a location on the downstream side of the second temperature detection portion 94 in the transport direction of the paper P.

As the powder spraying portion 96 illustrated in FIG. 1, it is possible to apply powder spray nozzles that are used as means for applying powder for blocking prevention in the printing field. To the powder spraying portion 96, it is possible to apply a blower mode, an electronic spraying mode, or the like.

As powder, it is possible to use blocking prevention powder that is used in the printing field. The powder may be any one of inorganic particles or organic particles. Examples of the powder are preferably starch coated with a silicone resin and particles of materials selected from the group consisting of silica, acrylic resins, styrene-based resins, silicone-based resins, and metallic oxides.

Examples of the acrylic resins include polymethyl acrylate and polymethyl methacrylate. Examples of the styrene-based resins include polystyrene. Examples of the metallic oxide include titanium oxide, magnesium oxide, and aluminium oxide.

Ink that is used for ink jet-type image formation has a larger content of water than non-ink jet-type printing ink that is used in the printing field. In such a case, in order to enhance rub resistance and prevent the generation of image defects in images, the powder is preferably hydrophobic. For example, hydrophobic powder such as starch coated with a silicone resin is more preferred.

The ink jet printing device 1 is configured as described above. Meanwhile, the feeder board 12 and the paper feeding drum 13 in the paper feeding portion 10, the treatment liquid application drum 21 in the treatment liquid application portion 20, the treatment liquid drying drum 31 in the treatment liquid drying portion 30, the printing drum 41 in the printing portion 40, the first chain delivery 51 in the ink drying portion 50, the varnish application drum 61 in the varnish application portion 60, and the second chain delivery 71 in the varnish post treatment portion 70 configure the transport portion of the paper P from the overall viewpoint of the ink jet printing device 1. Meanwhile, the transport portion is indicated by reference sign 105 in FIGS. 2 and 3.

[Description of Control System of Image-Forming Device]

Figure 2:
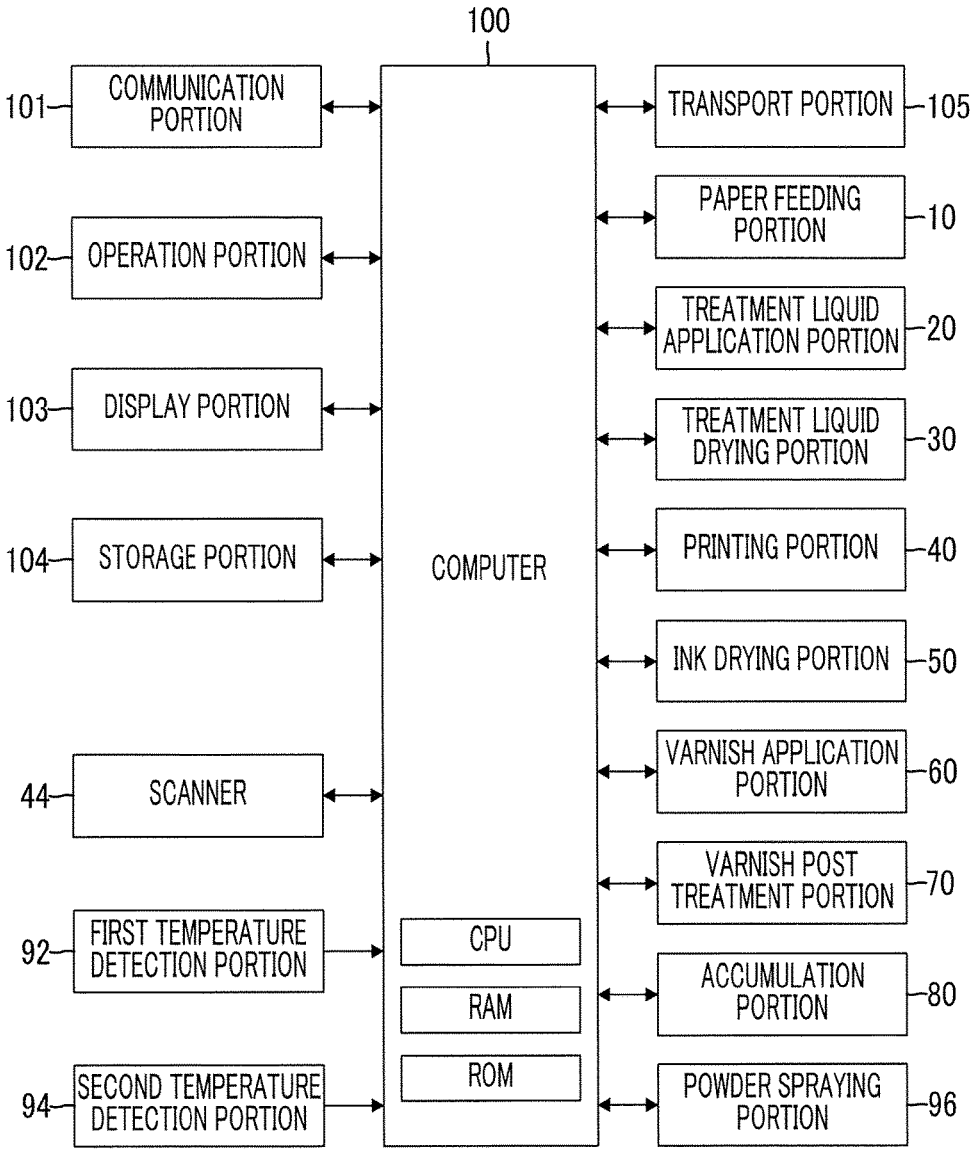
FIG. 2 is a block diagram illustrating a schematic configuration of a control system in the image-forming device illustrated in FIG. 1.

FIG. 2 is a block diagram illustrating a schematic configuration of a control system in the image-forming device illustrated in FIG. 1. The overall operation of the ink jet printing device 1 is controlled using a computer 100. The computer 100 includes CPU, RAM, and ROM.

To the computer 100, a communication portion 101, an operation portion 102, a display portion 103, and a storage portion 104 are connected. Meanwhile, CPU is the abbreviation of a central processing unit which indicates a central processing unit. RAM is the abbreviation of a random access memory. ROM is the abbreviation of a read only memory.

The communication portion 101 sends and receives data to and from external devices such as host computers. The communication portion 101 is provided with a well-known communication interface. As the operation portion 102, input devices such as mouse or key boards are applicable.

As the display portion 103, display devices such as liquid crystal monitors are applicable. As the storage portion 104, storage devices such as hard disk devices are applicable.

Programs executed using the computer 100 and a variety of data necessary to control the respective portions of the ink jet printing device 1 can be stored in ROM or the storage portion 104.

Figure 3:
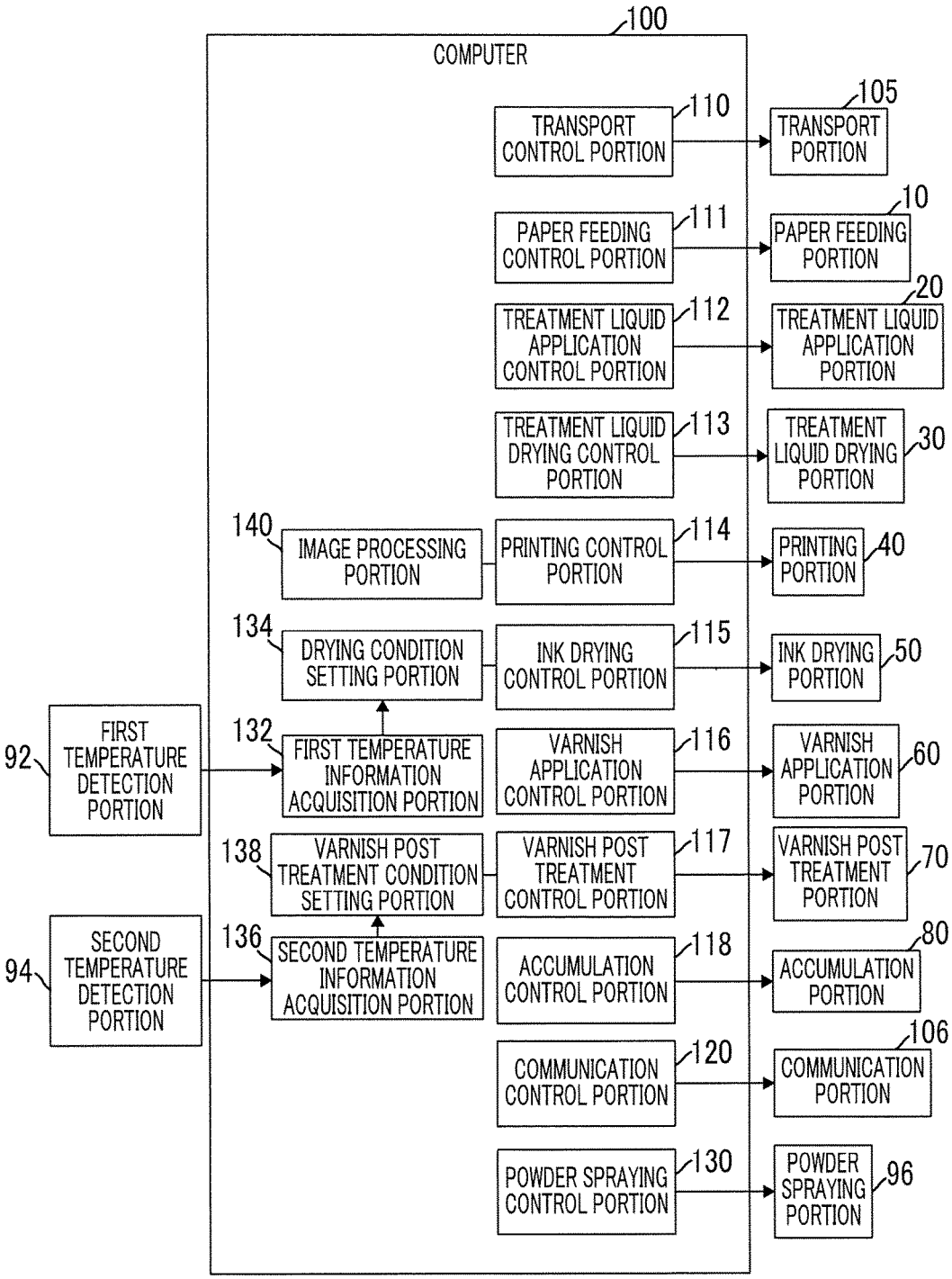
FIG. 3 is a block diagram of functions realized by a computer illustrated in FIG. 2.

FIG. 3 is a block diagram of functions realized by a computer illustrated in FIG. 2.

As illustrated in FIG. 3, the computer 100 functions as a transport control portion 110, a paper feeding control portion 111, a treatment liquid application control portion 112, a treatment liquid drying control portion 113, a printing control portion 114, an ink drying control portion 115, a varnish application control portion 116, a varnish post treatment control portion 117, an accumulation control portion 118, a communication control portion 120, a powder spraying control portion 130, a first temperature information acquisition portion 132, a drying condition setting portion 134, a second temperature information acquisition portion 136, and a varnish post treatment condition setting portion 138 when previously-prepared control programs are executed.

The transport control portion 110 controls the transport of the paper P by controlling the transport portion 105. Specifically, the transport control portion 110 controls the operation of transport means for the paper P included in the respective portions and applies a predetermined transport rate, thereby transporting the paper P being fed from the paper feeding portion 10. The transport portion 105 is an aspect of the medium transport portion.

The paper feeding control portion 111 controls the paper feeding of the paper P by controlling the paper feeding portion 10. Specifically, the paper feeding control portion 111 controls the operation of elements constituting the paper feeding portion 10 and sequentially feeds the paper P set on the paper feeding table sheet by sheet at predetermined paper feeding timings.

The treatment liquid application control portion 112 controls the application of the treatment liquid to the paper P by controlling the treatment liquid application portion 20. Specifically, the treatment liquid application control portion 112 controls the operation of individual elements constituting the treatment liquid application portion 20 and applies a predetermined thickness of the treatment liquid to the paper P.

The treatment liquid drying control portion 113 controls the drying of the treatment liquid applied to the paper P by controlling the treatment liquid drying portion 30. Specifically, the treatment liquid drying control portion 113 controls the operation of individual elements constituting the treatment liquid drying portion 30 and dries the treatment liquid applied to the paper P.

The printing control portion 114 controls the printing on the paper P by controlling the printing portion 40. Specifically, the printing control portion 114 controls the operation of individual elements constituting the printing portion 40 and prints images on the paper P.

The ink drying control portion 115 controls the drying of the ink by controlling the ink drying portion 50. Specifically, the ink drying control portion 115 controls the operation of individual elements constituting the ink drying portion 50 and dries the ink applied to the paper P using the printing portion 40. The ink drying control portion is an aspect of the drying treatment control portion.

The drying condition setting portion 134 sets ink drying conditions that satisfy predetermined stickiness evaluation values on the basis of the kind of varnish and the kind of ink. The ink drying control portion 115 controls the operation of the ink drying portion 50 on the basis of ink drying conditions set using the drying condition setting portion 134.

In the ink jet printing device 1, the ink drying portion 50 is feedback-controlled on the basis of the temperature of the paper P detected using the first temperature detection portion 92. That is, the temperature of the paper P detected using the first temperature detection portion 92 is sent to the drying condition setting portion 134 through the first temperature information acquisition portion 132.

The drying condition setting portion 134 changes the ink drying conditions on the basis of the temperature information of the paper P acquired through the first temperature information acquisition portion 132. That is, in a case in which the temperature of the paper P detected using the first temperature information acquisition portion 132 fails to satisfy predetermined stickiness evaluation values, the drying condition setting portion 134 changes the ink drying conditions. The ink drying control portion 115 controls the operation of the ink drying portion 50 on the basis of the changed ink drying conditions.

The setting of the ink drying conditions includes changes of the initial setting of the ink drying conditions and the preset ink drying conditions.

The varnish application control portion 116 controls the application of varnish on the paper P by controlling the varnish application portion 60. Specifically, the varnish application control portion 116 controls the operation of individual elements constituting the varnish application portion 60 and applies a predetermined thickness of varnish to the paper P.

The varnish post treatment control portion 117 controls the post treatment of varnish applied to the paper P by controlling the varnish post treatment portion 70. Specifically, the varnish post treatment control portion 117 controls the operation of individual elements constituting the varnish post treatment portion 70 and adjusts the drying degree of the varnish applied to the paper P. In addition, the varnish post treatment control portion 117 adjusts the cooling degree of the varnish applied onto the paper P in a case in which a cooling treatment portion, not illustrated, is provided.

The varnish post treatment condition setting portion 138 sets varnish post treatment conditions that satisfy predetermined stickiness evaluation values on the basis of the kind of varnish and the kind of ink. The varnish post treatment control portion 117 controls the operation of the varnish post treatment portion 70 on the basis of the varnish post treatment conditions set using the varnish post treatment condition setting portion 138.

In the ink jet printing device 1, the varnish post treatment portion 70 is feedback-controlled on the basis of the temperature of the paper P detected using the second temperature detection portion 94. That is, the temperature of the paper P detected using the second temperature detection portion 94 is sent to the varnish post treatment condition setting portion 138 through the second temperature information acquisition portion 136.

In a case in which the temperature of the paper P detected using the second temperature information acquisition portion 136 fails to satisfy predetermined stickiness evaluation values, the varnish post treatment condition setting portion 138 changes the varnish post treatment conditions on the basis of the temperature information of the paper P acquired through the second temperature information acquisition portion 136. The varnish post treatment control portion 117 controls the operation of the varnish post treatment portion 70 on the basis of the changed varnish post treatment conditions.

The setting of the varnish post treatment conditions includes changes of the initial setting of the varnish post treatment conditions and the preset varnish post treatment conditions.

The accumulation control portion 118 controls the accumulation of the paper P by controlling the accumulation portion 80. Specifically, the accumulation control portion 118 controls the driving of individual elements constituting the accumulation portion 80 and accumulates the paper P output from the varnish post treatment portion 70.

The communication control portion 120 controls data communication between external devices not illustrated and the communication control portion. That is, a communication portion 106 sends and receives data on the basis of command signals being sent from the communication control portion 120.

The powder spraying control portion 130 sprays powder to the paper P by controlling the powder spraying portion 96. The powder spraying control portion 130 operates the powder spraying portion 96 on the basis of preset powder spraying conditions.

Furthermore, the computer 100 functions as an image processing portion 140 when previously-prepared control programs are executed.

The image processing portion 140 carries out image processing on image input data acquired through the communication portion 106 and generates dot data in which dot dispositions of individual colors are indicated. The printing control portion 114 controls the operation of the printing portion 40 on the basis of the dot data.

Meanwhile, the respective portions are listed by functions in FIGS. 2 and 3. The respective portions illustrated in FIGS. 2 and 3 can be appropriately integrated, separated, used for multiple purposes, or removed. In addition, the respective portions illustrated in FIGS. 2 and 3 can be configured by appropriately combining hardware and software.

[Description of Order of Method for Forming Images According to First Embodiment]

Figure 4:
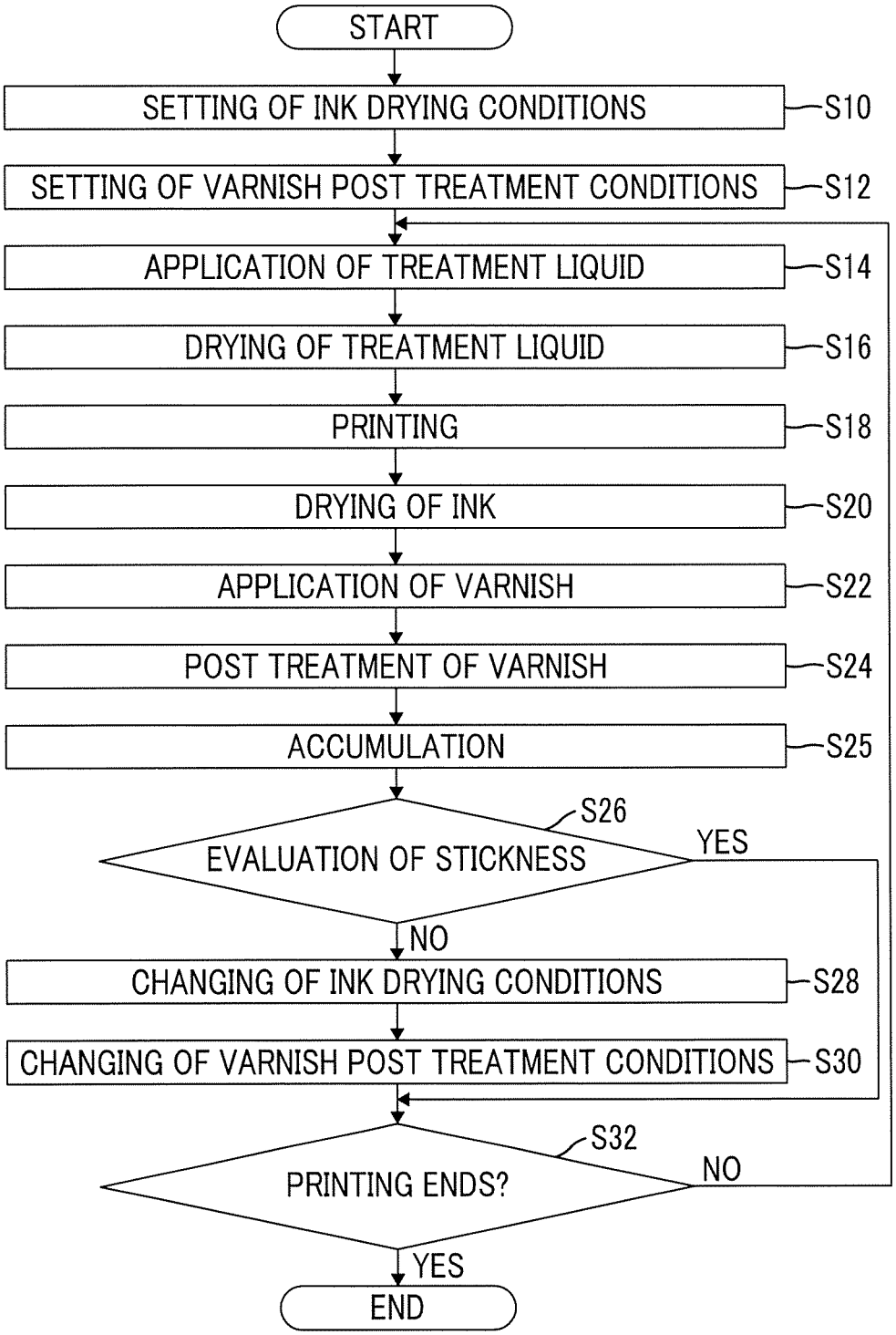
FIG. 4 is a flowchart illustrating an order of a method for forming images according to a first embodiment.

FIG. 4 is a flowchart illustrating the order of a method for forming an image according to a first embodiment. When the method for forming images is started, in an ink drying condition setting step S10, the ink drying conditions that are applied to the ink drying portion 50 illustrated in FIG. 1 are set.

After the ink drying conditions are set in the ink drying condition setting step S10 illustrated in FIG. 4, the process proceeds to a varnish post treatment condition setting step S12. In the varnish post treatment condition setting step S12, the varnish post treatment conditions that are applied to the varnish post treatment portion 70 illustrated in FIG. 1 are set.

After the varnish post treatment conditions are set in the varnish post treatment condition setting step S12 illustrated in FIG. 4, the process proceeds to a treatment liquid application step S14. In the treatment liquid application step S14, the treatment liquid is applied to the paper P using the treatment liquid application portion 20 illustrated in FIG. 1.

After the treatment liquid is applied to the paper P in the treatment liquid application step S14 illustrated in FIG. 4, the process proceeds to a treatment liquid drying step S16. In the treatment liquid drying step S16, the treatment liquid applied to the paper P using the treatment liquid drying portion 30 illustrated in FIG. 1 is dried.

After the treatment liquid applied to the paper P is dried in the treatment liquid drying step S16 illustrated in FIG. 4, the process proceeds to a printing step S18. In the printing step S18, printing is carried out on the paper P on which the treatment liquid has been dried in the printing portion 40 illustrated in FIG. 1.

After printing is carried out in the printing step S18 illustrated in FIG. 4, the process proceeds to an ink drying step S20. In the ink drying step S20, a drying treatment is carried out on the paper P on which printing has been carried out in the printing step S18 illustrated in FIG. 4 using the ink drying portion 50 illustrated in FIG. 1.

After the paper P is dried in the ink drying step S20, the process proceeds to a varnish application step S22. In the varnish application step S22, aqueous varnish is applied to the paper P on which an ink drying treatment has been carried out using the varnish application portion 60 illustrated in FIG. 1.

After the aqueous varnish is applied to the paper P in the varnish application step S22 illustrated in FIG. 4, the process proceeds to a varnish post treatment step S24. The varnish application step S22 is an aspect of a varnish application step.

In the varnish post treatment step S24, a varnish post treatment is carried out on the paper P to which the aqueous varnish has been applied using the varnish post treatment portion 70 illustrated in FIG. 1.

After the varnish post treatment is carried out on the paper P in the varnish pos treatment step S24 illustrated in FIG. 4, the process proceeds to an accumulation step S25. In the accumulation step S25, the paper P to which the varnish post treatment has been carried out in the varnish post treatment step S24 is accumulated in the accumulation portion 80 illustrated in FIG. 1.

When the paper P is accumulated in the accumulation step S25 illustrated in FIG. 4, the process proceeds to a stickiness evaluation step S26. In the stickiness evaluation step S26, whether or not the stickiness evaluation values indicating stickiness after the application of the varnish are in a predetermined range is determined.

The stickiness evaluation value has a correspondence relationship with the detected temperature of the first temperature detection portion 92 or the detected temperature of the second temperature detection portion 94 which are illustrated in FIG. 1, and thus whether or not the stickiness evaluation value is in a predetermined range is determined using the detected temperature of the first temperature detection portion 92 or the detected temperature of the second temperature detection portion 94. The details of the correspondence relationship between the stickiness evaluation value and the detected temperature of the first temperature detection portion 92 or the detected temperature of the second temperature detection portion 94 will be described below.

In the stickiness evaluation step S26, in a case in which the stickiness evaluation value indicating stickiness after the application of the varnish is outside the predetermined range, the result is determined as No. In the case of being determined as No, the process proceeds to an ink drying condition changing step S28.

In the ink drying condition changing step S28, the ink drying conditions of the ink drying portion 50 illustrated in FIG. 1 are changed. That is, in a case in which the detected temperature of the first temperature detection portion 92 illustrated in FIG. 1 is outside a range determined according to the kind of varnish and the kind of ink, the ink drying conditions are changed so that the ink drying intensity of the ink drying portion 50 is intensified.

After the ink drying conditions of the ink drying portion 50 illustrated in FIG. 1 are changed in the ink drying condition changing step S28 illustrated in FIG. 4, the process proceeds to a post treatment condition changing step S30 illustrated in FIG. 4. In the post treatment condition changing step S30, the varnish post treatment conditions which are cooling conditions of the cooling treatment portion not illustrated are changed.

That is, in a case in which the detected temperature of the second temperature detection portion 94 illustrated in FIG. 1 is outside a range determined according to the kind of varnish and the kind of ink, the cooling conditions are changed so that the cooling intensity of the cooling treatment portion not illustrated is intensified.

Meanwhile, the order of the ink drying condition changing step S28 and the post treatment condition changing step S30 which are illustrated in FIG. 4 may be switched.

After the varnish post treatment conditions of the varnish post treatment portion 70 illustrated in FIG. 1 are changed in the post treatment condition changing step S30 illustrated in FIG. 4, the process proceeds to an end-of-printing determination step S32 illustrated in FIG. 4.

In the stickiness evaluation step S26, in a case in which the stickiness evaluation value indicating stickiness after the application of the varnish is in the predetermined range, the result is determined as Yes. In the case of being determined as Yes, the process proceeds to the end-of-printing determination step S32.

In the end-of-printing determination step S32, whether or not printing is ended is determined. For example, when the number of sheets of the paper P on which images are printed reaches a preset number of sheets, printing is ended. On the other hand, when the number of sheets of the paper P on which images are printed is determined as not reaching the preset number of sheets, the process proceeds to the treatment liquid application step S14.

After that, the respective steps from the treatment liquid application step S14 through the end-of-printing determination step S32 are repetitively executed.

In the case of being determined as No in the stickiness evaluation step S26, there is a possibility of blocking occurring between sheets of the paper P used for the evaluation of stickiness in the accumulation portion 80 illustrated in FIG. 1. Therefore, on the paper P used for the evaluation of stickiness, an additional ink drying treatment or an additional varnish post treatment may be carried out.

Meanwhile, in the case of being determined as No in the stickiness evaluation step S26, the paper P used for the evaluation of stickiness may be differentiated from the paper P satisfying the evaluation conditions of the stickiness evaluation as the paper P not satisfying the evaluation conditions of the stickiness evaluation.

In the present embodiment, an aspect in which both the ink drying conditions and the varnish post treatment conditions are changed in the case of being determined as No in the stickiness evaluation step S26 has been described, but it is also possible to set the stickiness evaluation values in a predetermined range by changing at least one of the ink drying conditions and the varnish post treatment conditions.

The stickiness evaluation step may be carried out after the ink drying step S20. In a case in which the stickiness evaluation step is carried out after the ink drying step S20 and the paper P which has been subjected to the ink drying treatment is determined as No in the stickiness evaluation step, there might be a case in which the paper is determined as Yes in the stickiness evaluation step S26 after the varnish post treatment step S24 by carrying out the post treatment in the varnish post treatment step S24.

The method for forming images the order of which is illustrated in FIG. 4 includes a method for applying varnish. That is, it is possible to configure a method for applying varnish including the ink drying condition setting step S10, the varnish post treatment condition setting step S12, the ink drying step S20, the varnish application step S22, the varnish post treatment step S24, the stickiness evaluation step S26, the ink drying condition changing step S28, and the post treatment condition changing step S30 which are illustrated in FIG. 4. The method for applying varnish is an aspect of a method for applying varnish.

[Description of Order of Method for Forming Images According to Second Embodiment]

Figure 5:
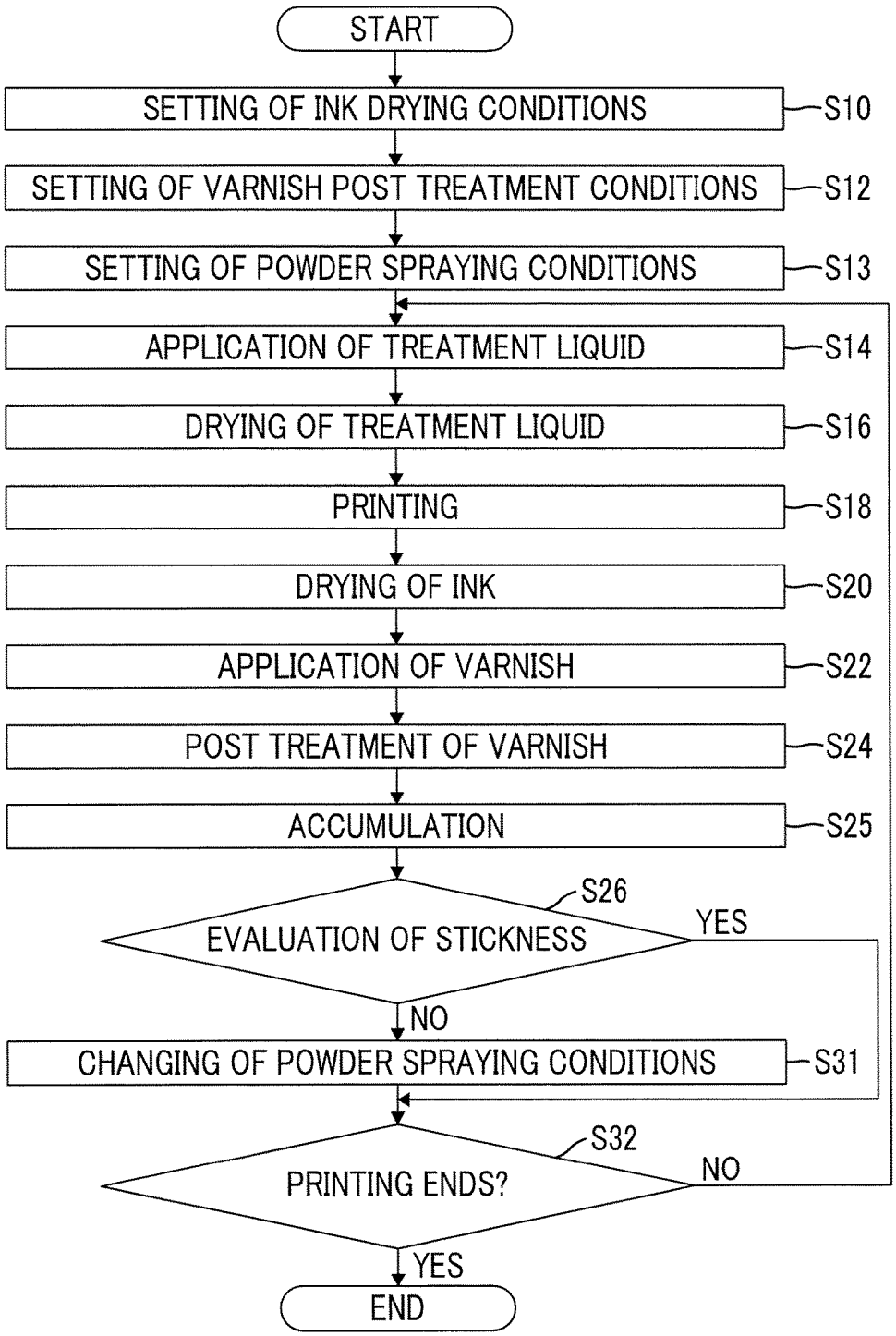
FIG. 5 is a flowchart illustrating an order of a method for forming an image according to a second embodiment.

FIG. 5 is a flowchart illustrating the order of a method for forming an image according to a second embodiment. Hereinafter, differences from the method for forming images according to the first embodiment will be mainly described. In the method for forming images the order of which is illustrated in FIG. 5, a powder spraying condition setting step S13 is carried out after the varnish post treatment condition setting step S12. In the powder spraying condition setting step S13, the powder spraying conditions in the powder spraying portion 96 illustrated in FIG. 1 are set. As the powder spraying conditions, it is possible to apply the amount of powder sprayed per unit time.

In the powder spraying condition setting step S13 illustrated in FIG. 5, after the powder spraying conditions in the powder spraying portion 96 illustrated in FIG. 1 are set, the process proceeds to the treatment liquid application step S14 illustrated in FIG. 4.

In addition, in the method for forming images the order of which is illustrated in FIG. 5, in the case of being determined as No in the stickiness evaluation step S26, the process proceeds to the powder spraying condition changing step S31. In the powder spraying condition changing step S31, the powder spraying conditions in powder spraying portion 96 illustrated in FIG. 1 are changed.

That is, in the case of being determined as No in the stickiness evaluation step S26 illustrated in FIG. 5, the amount of powder being sprayed to the paper P using the powder spraying portion 96 illustrated in FIG. 1 is relatively increased, thereby suppressing the occurrence of blocking in the accumulation portion 80 illustrated in FIG. 1.

Changes of the powder spraying conditions in the powder spraying condition changing step S31 illustrated in FIG. 5 include an aspect in which the powder spraying conditions under which the powder is not sprayed is changed to the powder spraying conditions under which the powder is sprayed.

In the method for forming images the order of which is illustrated in FIG. 4, an aspect in which the powder spraying condition changing step S31 illustrated in FIG. 5 is added after the post treatment condition changing step S30 and the powder spraying conditions under which the powder is not sprayed is changed to the powder spraying conditions under which the powder is sprayed in the powder spraying condition changing step S31 is also possible.

The method for forming images the order of which is illustrated in FIG. 5 includes a method for applying varnish. That is, it is possible to configure a method for applying varnish including the ink drying condition setting step S10, the varnish post treatment condition setting step S12, the powder spraying condition setting step S13, the ink drying step S20, the varnish application step S22, the varnish post treatment step S24, the stickiness evaluation step S26, and the powder spraying condition changing step S31 which are illustrated in FIG. 5.

[Description of Offline-Type Varnish Application]

Figure 6:
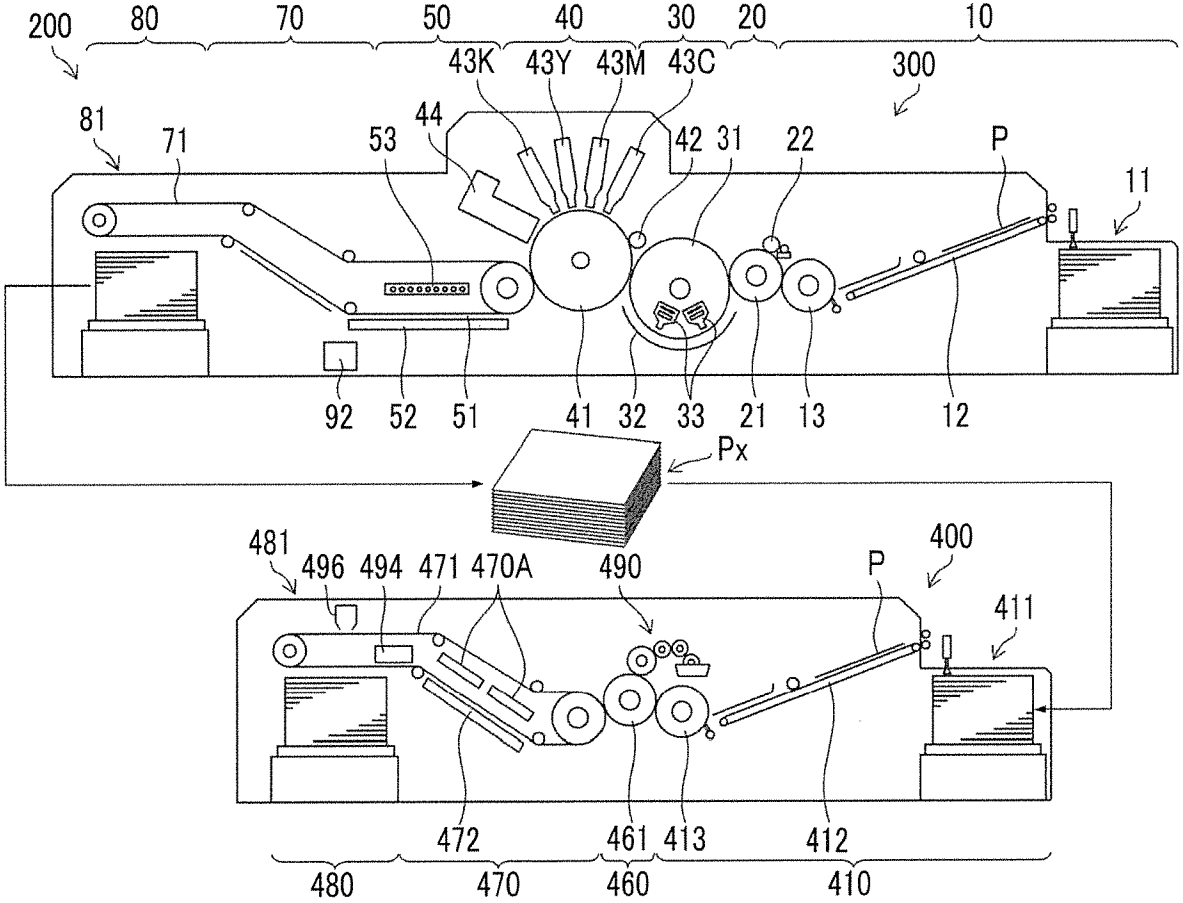
FIG. 6 is an overall configuration diagram of an image-forming system to which offline-type varnish application is applied.

FIG. 6 is an overall configuration diagram of an image-forming system to which offline-type varnish application is applied. In FIG. 6, as an example of the image-forming system to which offline-type varnish application is applied, an ink jet printing system 200 equipped with an ink jet printing device 300 and a varnish coating device 400 is illustrated.

A difference of the ink jet printing device 300 illustrated in FIG. 6 from the ink jet printing device 1 illustrated in FIG. 1 is that the varnish application portion 60 is not provided. Here, the configuration elements illustrated in FIG. 1 will not be described.

That is, the ink jet printing system 200 illustrated in FIG. 6 is an aspect in which printing and varnish coating are separately carried out, and offline-type varnish application in which the respective treatments are totally independently carried out is applied. In the offline-type varnish application, the paper P is temporarily accumulated after printing. In addition, there is a tendency that the period interval from printing to varnish application becomes longer.

Paper bundle Px extracted from the accumulation portion 80 in the ink jet printing device 300 is set in a paper feeding portion 410 in the varnish coating device 400. The paper bundle Px is coated with aqueous varnish using the varnish coating device 400. The transfer of the paper bundle Px from the ink jet printing device 300 to the varnish coating device 400 is an aspect of a transfer treatment portion.

In addition, the setting of the transfer period, the environment temperature, and the environmental relative humidity in the transfer of the paper bundle Px from the ink jet printing device 300 to the varnish coating device 400 are an aspect of the setting of transfer conditions using a transfer condition setting portion. The setting of the transfer period is an aspect of the setting of the transfer period.

Examples of the setting of the environment temperature in the transfer of the paper bundle Px from the ink jet printing device 300 to the varnish coating device 400 include 15° C. or higher and 35° C. or lower. The setting of the environment temperature is more preferably 20° C. or higher and 30° C. or lower. Examples of the setting of the environmental relative humidity include 35 percent or more and 65 percent or less. The setting of the environmental relative humidity is more preferably 40 percent or more and 60 percent or less.

The varnish coating device 400 illustrated in FIG. 6 includes the paper feeding portion 410, a varnish application portion 460, a varnish post treatment portion 470, and an accumulation portion 480.

The paper feeding portion 410, the varnish application portion 460, the varnish post treatment portion 470, and the accumulation portion 480 in the varnish coating device 400 have the same configurations and functions as those of the paper feeding portion 10, the varnish application portion 60, the varnish post treatment portion 70 which are illustrated in FIG. 1, and the accumulation portion 80 and thus will not be described herein.

A paper feeding device 411, a feeder board 412, and a paper feeding drum 413 provided in the paper feeding portion 410 illustrated in FIG. 6 respectively have the same configurations and functions as those of the paper feeding device 11, the feeder board 12, and the paper feeding drum 13 which are illustrated in FIG. 1 and thus will not be described herein.

A varnish application drum 461 and a varnish coater 490 provided in the varnish application portion 460 illustrated in FIG. 6 respectively have the same configurations and functions as those of the varnish application drum 61 and the varnish coater 90 which are illustrated in FIG. 1 and thus will not be described herein.

A second heating device 470A, a second chain delivery 471, and a third paper guide 472 provided in the varnish post treatment portion 470 illustrated in FIG. 6 respectively have the same configurations and functions as those of the second heating device 70A, the second chain delivery 71, and the third paper guide 72 which are illustrated in FIG. 1 and thus will not be described herein.

An accumulation device 481 provided in the accumulation portion 480 illustrated in FIG. 6 has the same configurations and functions as those of the accumulation device 81 illustrated in FIG. 1 and thus will not be described herein.

A second temperature detection portion 494 and a powder spraying portion 496 which are illustrated in FIG. 6 respectively have the same configurations and functions as those of the second temperature detection portion 94 and the powder spraying portion 96 which are illustrated in FIG. 1 and thus will not be described herein.

To the ink jet printing system 200 illustrated in FIG. 6, it is possible to apply a configuration in which the control system of the ink jet printing device 1 illustrated in FIGS. 2 and 3 is separated into a control system of the ink jet printing device 300 and a control system of the varnish coating device 400.

The computer 100, the communication portion 101, the operation portion 102, the display portion 103, the storage portion 104, and the transport portion 105 which are illustrated in FIG. 2 are provided in both the ink jet printing device 300 and the varnish coating device 400.

For the ink jet printing device 300 and the varnish coating device 400 which are illustrated in FIG. 6, the computer 100, the communication portion 101, the operation portion 102, the display portion 103, the storage portion 104, and the transport portion 105 which are illustrated in FIG. 2 may be commonly used.

To the ink jet printing system 200 illustrated in FIG. 6, it is possible to apply the method for forming images illustrated in FIGS. 4 and 5 and the method for applying varnish, which is a configuration element of the method for forming images, illustrated in FIGS. 4 and 5.

[Description of Online-Type Varnish Application]

Figure 7:
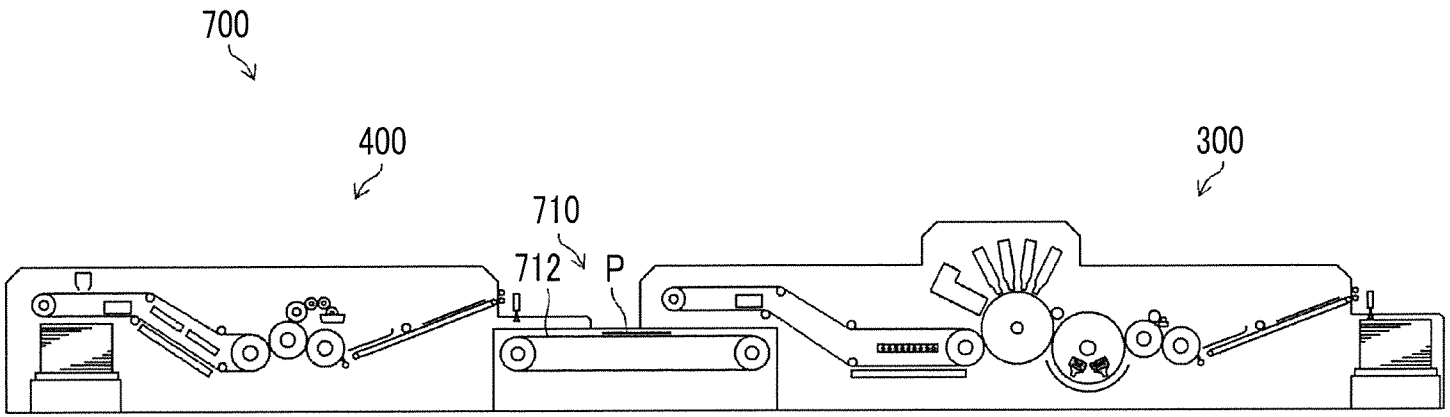
FIG. 7 is an overall configuration diagram of an image-forming system to which online-type varnish application is applied.

FIG. 7 is an overall configuration diagram of an image-forming system to which online-type varnish application is applied. In FIG. 7, as an example of the image-forming system to which online-type varnish application is applied, an ink jet printing system 700 equipped with the ink jet printing device 300, the varnish coating device 400, and a transfer device 710 is illustrated.

Meanwhile, in FIG. 7, the configuration elements of the ink jet printing device 300 and the configuration elements of the varnish coating device 400 which are illustrated in FIG. 6 will not be given reference symbols.

The ink jet printing device 300 and the varnish coating device 400 which are illustrated in FIG. 7 have the same configurations and functions as those of the ink jet printing device 300 and the varnish coating device 400 which are illustrated in FIG. 6 and thus will not be described herein.

The transfer device 710 includes a conveyor 712. The paper P being ejected from a paper ejection location of the ink jet printing device 300 using the conveyor 712 is transferred to the varnish coating device 400.

The conveyor 712 receives the paper P being ejected from the paper ejection location of the ink jet printing device 300, transports the paper P along a transport path of the paper P, and delivers the paper to the paper feeding portion 410 of the varnish coating device 400.

The paper feeding portion 410 of the varnish coating device 400 receives the paper P from the conveyor 712 and sequentially feeds the paper to the varnish application portion 460. The paper P is collected in the accumulation portion 480 of the varnish coating device 400. The paper P is stacked and collected in a bundle shape in the accumulation portion 480 of the varnish coating device 400.

In a case in which printing is carried out, the ink jet printing device 300 and the varnish coating device 400 operate in association with each other. In a case in which varnish is not applied, the varnish application function and the varnish post treatment function of the varnish coating device 400 may be paused. In a case in which varnish is not applied, the paper P passes through the varnish application portion 460 and the varnish post treatment portion 470 of the varnish coating device 400 and is accumulated in the accumulation portion 480.

The transfer device 710 may include a heating treatment portion that heats the paper P. The heating treatment portion may be provided in the conveyor 712. The transfer device 710 is an aspect of the transfer treatment portion. The setting of the transfer rate in the transfer device 710 and the setting of the heating conditions of the heating treatment portion provided in the transfer device 710 are an aspect of the setting of the transfer conditions being used in the transfer condition setting portion.

To the ink jet printing system 700 illustrated in FIG. 7, it is possible to apply a configuration in which the control system of the ink jet printing device 1 illustrated in FIGS. 2 and 3 is separated into the control system of the ink jet printing device 300 and the control system of the varnish coating device 400. In addition, a control portion of the transfer device 710 illustrated in FIG. 7 is provided.

The computer 100, the communication portion 101, the operation portion 102, the display portion 103, the storage portion 104, and the transport portion 105 which are illustrated in FIG. 2 are provided in all of the ink jet printing device 300 and the varnish coating device 400.

For the ink jet printing device 300 and the varnish coating device 400 which are illustrated in FIG. 7, the computer 100, the communication portion 101, the operation portion 102, the display portion 103, the storage portion 104, and the transport portion 105 which are illustrated in FIG. 2 may be commonly used.

To the ink jet printing system 700 illustrated in FIG. 7, it is possible to apply the method for forming images illustrated in FIGS. 4 and 5 and the method for applying varnish, which is a configuration element of the method for forming images, illustrated in FIGS. 4 and 5.

The online-type varnish application refers to a format in which printing and varnish application are continuously carried out as a series of treatments. Online varnish application is carried out by connecting the printing device and the varnish coating device in a series.

That is, immediate feeding of paper being ejected from the printing device to the varnish coating device enables continuous treatments. The online-type varnish application is identical to the inline-type varnish application illustrated in FIG. 1 since printing and varnish application are continuously carried out, but is different from inline-type varnish application since printing and varnish application are carried out using separate devices.

Therefore, this difference causes the period interval from the end of the ink drying treatment after printing to varnish application to be longer than that of the inline-type varnish application. Meanwhile, the online-type varnish application in which paper being ejected from the printing device is immediately fed into the varnish coating device is different from the offline-type varnish application since paper which has been subjected to the ink drying treatment after printing is not accumulated before varnish application.

[Description of Evaluation of Stickiness]

<Description of Derivation of Stickiness Evaluation Value>

Figure 8:
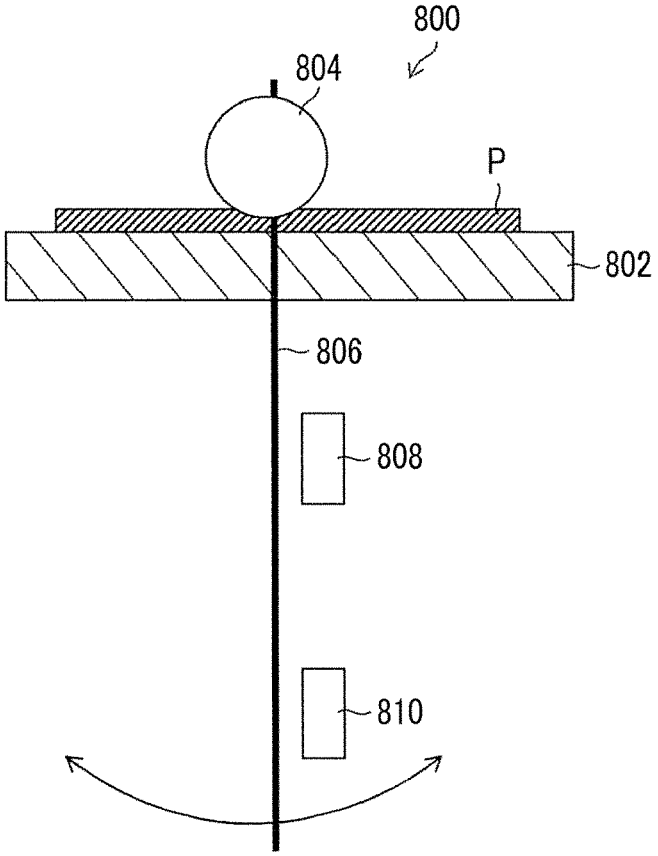
FIG. 8 is an explanatory view of a principle for measuring damped vibrations which are applied to derivation of stickiness evaluation values.
Figure 9:
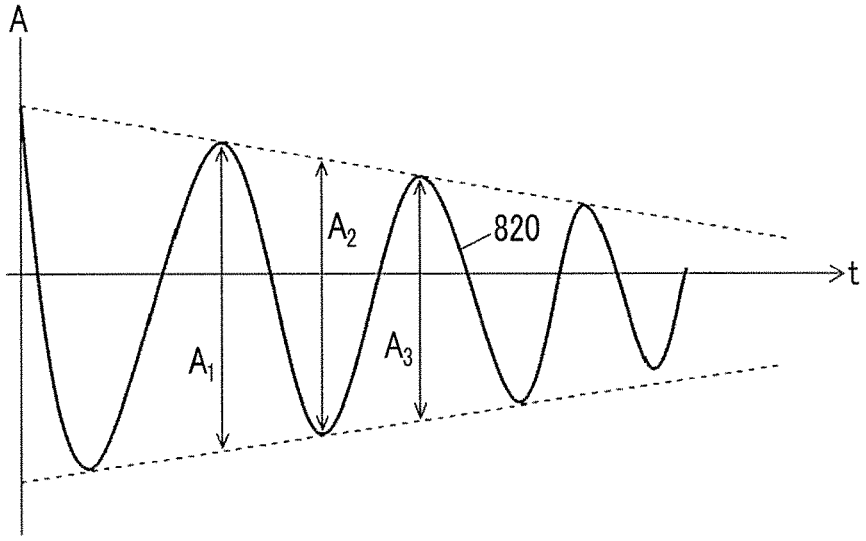
FIG. 9 is a schematic view of the damped vibration.

FIG. 8 is an explanatory view of a principle for measuring damped vibrations which are applied to derivation of stickiness evaluation values. FIG. 9 is a schematic view of the damped vibration. The stickiness evaluation value is an index indicating the degree of stickiness of aqueous varnish after the application of the aqueous varnish and a predetermined post treatment of the varnish.

A stickiness measurement device 800 illustrated in FIG. 8 includes a specimen table 802, a cylinder edge 804, a pendulum 806, a detector 808, and a magnet 810.

On the specimen table 802, the paper P coated with aqueous varnish which is a measurement subject is mounted. One end of the pendulum 806 is linked to the cylinder edge 804. The cylinder edge 804 is placed on the aqueous varnish applied to the paper P.

The pendulum 806 is supported so as to be capable of doing pendulum motions from the contact point between the aqueous varnish applied to the paper P and the cylinder edge 804 as the pivot. The curve of a double-headed arrow illustrated in FIG. 8 indicates the moving direction of the pendulum 806 during the pendulum motion of the pendulum 806.

The detector 808 detects the location of the pendulum 806 caused to do pendulum motions. As the detector 808, non-contact-type eddy current displacement sensors are applicable. The detailed structure of the detector 808 is not illustrated, but the detector 808 is equipped with a detection element and a driver.

The magnet 810 is means for applying initial vibrations to the pendulum 806 when the pendulum 806 is caused to do pendulum motions. For example, the pendulum 806 is adsorbed to the magnet 810 using the magnetic force of the magnet 810.

In addition, when the magnetic force of the magnet 810 is removed and thus the pendulum 806 is released from the magnet 810, the pendulum 806 can be caused to do pendulum motions in the direction indicated by the curve of the double-headed arrow illustrated in FIG. 8.

A damped vibration curve 820 illustrated in FIG. 9 indicates a change in the amplitude of the pendulum during the pendulum motions of the pendulum 806 illustrated in FIG. 8. The horizontal axis in FIG. 9 indicates time t. The unit of the horizontal axis is seconds. The vertical axis in FIG. 9 indicates the amplitude A of the pendulum 806 illustrated in FIG. 8. The unit of the vertical axis is millimeters.

A stickiness evaluation value S is indicated using Expression (1) below.

$$S=\{1n(A_1/A_2)+1n(A_2/A_3)+\ldots+1n(A_{n-1}/A_n)\}/n \ldots \quad (1)$$

Meanwhile, $A_1$, $A_2$, $A_3$, . . . , $A_{n-1}$, and $A_n$ in Expression (1) indicate the first to $n^{th}$ amplitudes of the damped vibration curve 820 illustrated in FIG. 9. In addition, n is an integer of 2 or more. The amplitude $A_{n-1}$ and the amplitude $A_n$ are not illustrated.

The stickiness evaluation value of the aqueous varnish described using FIGS. 8 and 9 can be measured using a rigid-body pendulum-type physical properties testing instrument RPT-3000W manufactured by A&D Company, Limited. Meanwhile, RPT-3000W is a model code.

That is, the logarithm damped vibration percentage of the amplitude of the pendulum supported in the direction of gravitational force from the pivot which is an arbitrary location of the aqueous varnish applied to the paper P when the pendulum is caused to do pendulum motions is applicable as the stickiness evaluation value.

The conditions for measuring the stickiness evaluation values using a rigid-body pendulum-type physical properties testing instrument RPT-3000W manufactured by A&D Company, Limited are as described below.

The paper P coated with the aqueous varnish is cut into sizes corresponding to the sizes of glass slides being used to mount the paper on the specimen table 802 illustrated in FIG. 8. The cut paper P is placed on the glass slide, and the paper P is fixed to the glass slide. The paper P may be fixed to the glass slide using pressure-sensitive adhesive tape. When the glass slide to which the paper P is fixed is mounted on the specimen table 802 illustrated in FIG. 8, the measurement begins.

As the measurement environment, an environment temperature of 15° C. or higher and 35° C. or lower and an environmental relative humidity of 35 percent or more and 65 percent or less are applicable. The environment temperature may be set to 20° C. or higher and 30° C. or lower. The environmental relative humidity may be set to 40 percent or more and 60 percent or less.

As the measurement environment, normal temperature environment and normal humidity environment may be applied. As the normal temperature environment, 23° C. determined by ISO 554-1976 is applicable. In addition, as the normal humidity environment, a relative humidity of 50 percent determined by ISO 554-1976 is applicable. ISO is the abbreviation of International Organization for Standardization indicating the international organization for standardization.

Figure 10:
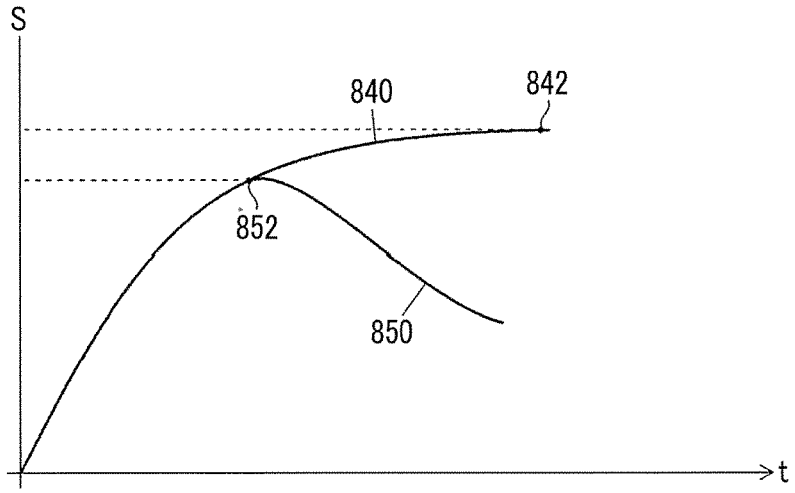
FIG. 10 is an explanatory view schematically illustrating elapsed time and changes in damped vibration percentages.

When the measurement begins, the damped vibration percentage in the pendulum motions of the pendulum 806 illustrated in FIG. 8 is acquired. FIG. 10 is an explanatory view schematically illustrating elapsed time and changes in damped vibration percentages. As indicated by reference sign 840 in FIG. 10, the damped vibration percentage in the pendulum motions of the pendulum 806 converges after a certain period elapses from the beginning of the measurement. A convergent value 842 of the damped vibration percentage in the pendulum motions of the pendulum 806 is acquired as the stickiness evaluation value.

Meanwhile, as indicated by reference sign 850 in FIG. 10, there may be cases in which the damped vibration percentage in the pendulum motions of the pendulum 806 does not converge. In a case in which the damped vibration percentage in the pendulum motions of the pendulum 806 does not converge, the maximum value 852 after a predetermined period elapses is acquired as the stickiness evaluation value. As the predetermined period, 20 seconds is applicable. That is, the number of vibrations generated during the predetermined period is considered as the maximum value of n.

In the measurement of the stickiness evaluation values described above, the measurement of the stickiness evaluation values is begun within two minutes from a timing at which the paper P is output from the ink jet printing device 1 illustrated in FIG. 1.

[Detailed Description of Evaluation of Stickiness]

Next, the evaluation of stickiness will be described in detail.

<Measurement Conditions>

As the ink jet printing device 300 illustrated in FIG. 6, Jet Press 720S manufactured by Fujifilm Corporation is applied. As the varnish coating device 400 illustrated in FIG. 6, Digi-Coater manufactured by Toyotec Co., Ltd. is applied.

Treatment liquid, ink, aqueous varnish, and paper being used are as described below.

Treatment liquid: C-FJ-CP manufactured by Fujifilm Corporation

Ink: C-WP-Q manufactured by Fujifilm Corporation

Varnish: HYDLITH2012-R1 manufactured by DIC

Paper: New-DV 310GSM manufactured by Hokuetsu Kishu Paper Co., Ltd.

Meanwhile, GSM is a unit indicating the thickness of the paper. A thickness of the paper being 1 gram per square meter is 1 GSM. There are cases in which GSM is expressed by grams per square meter or $g/m^2$.

<In the Case of Offline-Type Varnish Application>

FIG. 11 is a table showing the evaluation results of stickiness in the offline-type varnish application. To the stickiness evaluation the evaluation results of which are illustrated in FIG. 11, the ink jet printing system 200 illustrated in FIG. 6 can be applied.

Tests 1 to 6 illustrated in FIG. 11 indicate the relationships between stickiness evaluation values and blocking performance in cases in which the period from the end of the ink drying treatment through varnish application is changed. The stickiness evaluation values are derived using Expression (1).

Printing conditions are as described below. Magenta ink and cyan ink are used, and 50 millimeter-wide blue stripe images are formed on ten sheets of the paper. The volume of one ink droplet is set to 5.2 picoliters.

The application conditions of the varnish are as described below. As the amount of varnish applied, an arbitrary amount applied of 2.0 grams or more and 6.0 grams or less per square meter is applied. The amount of the varnish applied per sheet of the paper is the same amount. The amount of the varnish applied may be an arbitrary amount applied of 3.5 grams or more and 4.5 grams or less per square meter.

The accumulation conditions of the paper are as described below. A predetermined treatment is carried out on ten sheets of the paper on which printing is carried out by applying the above-described printing conditions, and the ten sheets of the treated paper are overlaid together. A weight having a mass corresponding to the mass of 500 sheets of the paper is placed on the ten sheets of the paper.

After six hours elapses from the placement of the weight on the ten sheets of the paper, the state of blocking occurrence is checked in each of the ten sheets of the paper. The state of blocking occurrence is visually checked. The blocking performance illustrated in FIG. 11 indicates the state of blocking occurrence.

The blocking performance is evaluated into four levels described below. In a case in which blocking does not occur, the blocking performance is evaluated as A. In a case in which blocking occurs in a range permissible from the viewpoint of image qualities, the blocking performance is evaluated as B.

In a case in which blocking occurs in a range permissible under conditions of studying operation methods, the blocking performance is evaluated as C. In a case in which blocking that is not permissible occurs, the blocking performance is evaluated as D.

The film surface temperature after the ink drying treatment in FIG. 11 is the temperature of image surfaces formed on the paper P which is detected using the first temperature detection portion 92 illustrated in FIG. 6. The film surface temperature after the ink drying is set to 70° C.

The paper ejection temperature in FIG. 11 is the temperature of the paper P detected using the second temperature detection portion 494 illustrated in FIG. 6. The paper ejection temperature is set to 50° C. The powder is not sprayed.

As illustrated in FIG. 11, in a case in which the period from the end of the ink drying treatment through the beginning of the varnish application is ten minutes or longer, blocking does not occur. In addition, if the period from the end of the ink drying treatment through the beginning of the varnish application is five minutes or longer, blocking occurs in a range permissible under conditions of studying operation methods.

In other words, when the stickiness evaluation value is 0.20 or less, blocking occurs in a range permissible under conditions of studying operation methods or blocking does not occur. Therefore, the occurrence of blocking during the accumulation of paper is suppressed by applying conditions under which the stickiness evaluation value reaches 0.20 or less.

In addition, the occurrence of blocking during the accumulation of paper is further suppressed by applying conditions under which the stickiness evaluation value reaches 0.18 or less.

The stickiness of varnish is a cause of the mixing of solvents in ink into layers of varnish. When the period from ink drying through varnish application becomes relatively long, the permeation of solvents in ink remaining in layers of the ink into paper proceeds.

In such a case, the stickiness of varnish is suppressed by relatively decreasing the amount of solvents in the ink which are mixed into layers of varnish after the application of the varnish.

Meanwhile, a treatment for allowing a period from the end of the ink drying treatment through the beginning of varnish application is an aspect of the treatment of the treatment portion and is an aspect of the transfer of the transfer treatment portion. That is, in the ink jet printing system 200 to which the offline-type varnish application illustrated in FIG. 6 is applied, when a transfer treatment is carried out so that the transfer period of the paper bundle Px is set to ten minutes or longer, a treatment of setting the stickiness evaluation value to 0.20 or less is possible.

<In the Case of Online-Type Varnish Application>

FIG. 12 is a table showing the evaluation results of stickiness evaluation in the online-type varnish application. Meanwhile, items in FIG. 12 to which the same conditions as in FIG. 11 are applied will appropriately not be described.

To the stickiness evaluation the evaluation result of which are illustrated in FIG. 12, the ink jet printing system 700 illustrated in FIG. 7 is applicable.

In actual stickiness evaluation the evaluation results of which are illustrated in FIG. 12, printing is carried out on paper using the ink jet printing system 200 illustrated in FIG. 6, and, in the online-type varnish application, varnish is applied to the printed paper using the varnish coating device 400 within a period corresponding to the transfer period in which the transfer device 710 illustrated in FIG. 7 is used.

The period from the end of the ink drying treatment through the beginning of varnish application in FIG. 12 is a period corresponding to the transfer period in which the transfer device 710 illustrated in FIG. 7 is used.

In Tests 11 through 25 illustrated in FIG. 12, in the period from the end of the ink drying treatment through the beginning of varnish application, a heating treatment is carried out on the printed paper. Conditions for the heating treatment are shown in the column 'reached film surface temperature and heating period during varnish application'.

In Test 11, the surface temperature of images printed on the paper is increased from 50° C. to 60° C. in one second. That is, in the column 'reached film surface temperature and heating period during varnish application', numerical values on the left side of the slash indicate the surface temperatures of images printed on the paper after the heating treatment, and numerical values on the right side of the slash indicate the heating treatment periods. The surface temperature of images printed on the paper after the heating treatment is the reached film surface temperature.

In Tests 11 through 18, the blocking performance is evaluated by changing the reached film surface temperature and the heating period during varnish application. Specifically, hot air is blown to the paper on which the ink drying treatment has been carried out using a dryer.

In Tests 11 through 14, the setting of the heating intensity of the dryer remains unchanged, and the operation period of the dryer is changed. In Tests 15 through 18, the operation period of the dryer is fixed to five seconds, and the setting of the heating intensity of the dryer is changed.

According to the evaluation results of Tests 11 through 18, as the temperature after the heating treatment increases or the heating treatment period increases, the stickiness evaluation value becomes relatively smaller. As the stickiness evaluation value decreases, the blocking performance falls in a permissible range, and the occurrence of blocking is suppressed.

In other words, when the stickiness evaluation value is 0.24 or less, blocking occurs in a range permissible under conditions of studying operation methods or blocking does not occur. Therefore, the occurrence of blocking during the accumulation of paper is suppressed by applying conditions under which the stickiness evaluation value reaches 0.24 or less.

As previously described, the stickiness of varnish is a cause of the mixing of solvents in ink into layers of varnish. When the heating treatment is carried out after the ink drying treatment and before the beginning of varnish application, the viscosity of the solvents in the ink decreases. When the viscosity of the solvents in the ink decreases, the permeation of the solvents in the ink is accelerated.

In such a case, the stickiness of varnish is suppressed by relatively decreasing the amount of solvents in the ink which are mixed into layers of varnish after the application of the varnish.

In Tests 19 through 25 the evaluation results of which are illustrated in FIG. 12, the temperature of the rear side surface of the printed paper opposite to the printed surface is increased and kept constant using a hot plate. In the column 'reached film surface temperature and heating period during varnish application' for Tests 19 through 25, numerical values on the left side of the slash indicate the set temperatures of the hot plate, and numerical values on the right side of the slash indicate the heating treatment periods. The surface temperature of images printed on the paper after the heating treatment is the reached film surface temperature.

In a case in which the set temperature of the hot plate is 50° C., the temperature of the rear side surface is kept constant, and, in a case in which the set temperature of the hot plate is 60° C., the temperature of the rear side surface is increased.

According to the evaluation results of Tests 19 through 25, as the temperature after the heating treatment increases or the heating treatment period increases, the stickiness evaluation value becomes relatively smaller. As the stickiness evaluation value decreases, the blocking performance falls in a permissible range, and the occurrence of blocking is suppressed.

In other words, when the stickiness evaluation value is 0.24 or less, blocking occurs in a range permissible under conditions of studying operation methods or blocking does not occur. Therefore, the occurrence of blocking during the accumulation of paper is suppressed by applying conditions under which the stickiness evaluation value reaches 0.24 or less.

In addition, when the drying treatment is carried out on the paper after the ink drying treatment and before varnish application, the period from the end of the ink drying treatment through varnish application can be shortened from ten minutes to a range of 1.2 minutes to 3.4 minutes.

<In the Case of Inline-Type Varnish Application>

FIG. 13 is a table showing the evaluation results of stickiness evaluation in the inline-type varnish application.

Meanwhile, items in FIG. 13 to which the same conditions as in FIGS. 11 and 12 are applied will appropriately not be described.

To the stickiness evaluation the evaluation result of which are illustrated in FIG. 13, the ink jet printing device 1 illustrated in FIG. 1 is applicable. Printing conditions and the accumulation conditions of the paper in Tests 31 through 42 the evaluation results of which are illustrated in FIG. 13 are as described below.

The same image as in the offline-type varnish application is printed on 500 sheets of paper. 500 sheets of the printed paper are loaded, and the state of blocking occurrence is checked in paper arbitrarily extracted from the 500 sheets of the paper after the elapse of six hours. The state of blocking occurrence is visually checked.

In the stickiness evaluation the evaluation results of which are illustrated in FIG. 13, the period from the end of the ink drying treatment through varnish application is 0.1 minutes or shorter.

In Tests 31 through 34 illustrated in FIG. 13, the paper ejection temperature is changed. The paper ejection temperature is the temperature of paper which is detected using the first temperature detection portion 92 illustrated in FIG. 1. In the ink jet printing device 1 illustrated in FIG. 1, the ink drying portion 50 and the varnish application portion 60 are directly linked to each other, and thus the paper ejection temperature is changed in Tests 31 through 34 the evaluation results of which are illustrated in FIG. 13. In a case in which the cooling treatment is not carried out on the paper coated with varnish, the paper ejection temperature is 45° C. in the ink jet printing device 1 illustrated in FIG. 1.

In a case in which the paper ejection temperature is 45° C., the blocking performance is evaluated as D, and blocking that is not permissible occurs. On the other hand, in a case in which the cooling treatment is carried out on the paper coated with varnish and the paper ejection temperature is 40° C. or lower, the blocking performance is evaluated as A, B, or C, and blocking occurs in a permissible range or blocking does not occur.

In Tests 31 through 34, in a case in which the blocking performance is evaluated as A, B, or C, the stickiness evaluation value is 0.24 or lower.

Tests 35 and 36 the evaluation results of which are illustrated in FIG. 13 are cases in which the cooling treatment is carried out on the varnish application drum 61 illustrated in FIG. 1. That is, in Tests 35 and 36, blocking in a case in which the reached temperature of the circumferential surface of the varnish application drum 61 during printing becomes relatively low is evaluated.

To the cooling treatment on the varnish application drum 61, the blowing of hot air to the circumferential surface of the varnish application drum 61 is applied. Water cooling-type cooling treatments in which cooling water is circulated in the varnish application drum 61 are also applicable.

The paper ejection temperature is 35° C. in Test 35. The blocking performance is evaluated as B in Test 35. The paper ejection temperature is 30° C. in Test 36. The blocking performance is evaluated as A in Test 36.

To the varnish application drum 61 illustrated in FIG. 1, heat is transferred from the printing portion 40 performing printing or heat is transferred from the paper which has been subjected to the ink drying treatment, and the temperature of the circumferential surface gradually increases. As a result, it becomes difficult to cool the circumferential surface of the varnish application drum 61 during the latter half of the printing of a plurality of sheets. In such a case, the temperature of the circumferential surface of the varnish application drum 61 gradually increases.

When the circumferential surface of the varnish application drum 61 is cooled in order to improve the gradual increase in the temperature of the circumferential surface of the varnish application drum 61, the cooling of the paper which is necessary in the varnish post treatment portion 70 or the accumulation portion 80 is suppressed.

Tests 37 through 39 the evaluation results of which are illustrated in FIG. 13 are cases in which the ink drying treatment is intensified and the surface temperature of images printed on the paper becomes relatively higher. When the surface temperature of images printed on the paper becomes relatively higher, the permeation of the solvents in the ink into the paper or the volatilization of the ink solvents in the ink drying portion 50 illustrated in FIG. 1 is accelerated.

Tests 40 through 42 the evaluation results of which are illustrated in FIG. 13 are cases in which powder is sprayed to images printed on the paper before the accumulation of the paper coated with varnish. In Tests 40 through 42, the amount of the powder sprayed is changed. As the powder, CROWN manufactured by Toho Seiki Co., Ltd. is applied.

When the amount of the powder sprayed increases relatively, the contact between sheets of paper being loaded is inhibited, and thus stickiness becomes small. In such a case, the occurrence of blocking is suppressed. The amount of the powder sprayed to one sheet of the paper illustrated in FIG. 13 is computed by dividing the amount of the powder consumed by the number of sheets of the paper to which the powder has been sprayed.

<Summary of Stickiness Evaluation>

In cases in which the blocking performance in the tables illustrated in FIGS. 11 to 13 is A, B, or C, blocking is permissible. That is, in any of the offline-type varnish application, the online-type varnish application, and the inline-type varnish application, in a case in which the stickiness evaluation value is 0.24 or less, the blocking performance is any one of A, B, or C.

Meanwhile, in the evaluation results of stickiness illustrated in FIG. 11, in a case in which the stickiness evaluation value is 0.20, the blocking performance is C, and, in a case in which the stickiness evaluation value is 0.26, the blocking performance is D. It is considered that the boundary between the blocking performance of C and the blocking performance of D is present between stickiness evaluation values of 0.20 and 0.26.

When the evaluation results of stickiness illustrated in FIGS. 12 and 13 are taken into account, even in the case of the offline-type varnish application, the blocking performance is predicted to be any one of A, B, or C when the stickiness evaluation value is 0.24 or less.

In a case in which the stickiness evaluation value is less than 0.20, the blocking performance is any one of A or B. In Test 3 illustrated in FIG. 11, the stickiness evaluation value is 0.20, and the blocking performance is evaluated as C. In Test 33 illustrated in FIG. 13, the stickiness evaluation value is 0.19, and the blocking performance is evaluated as B.

The boundary between the blocking performance of B and the blocking performance of C is present between a stickiness evaluation value of 0.19 and a stickiness evaluation value of 0.20. Since the blocking performance monotonously increases or decreases as the stickiness evaluation value increases or decreases, the blocking performance is considered to be A or B in a case in which the stickiness evaluation value is less than 0.20.

In a case in which the film surface temperature after the ink drying treatment is monitored, and the film surface temperature after the ink drying treatment is not in a range of the film surface temperature after the ink drying treatment in which the blocking performance becomes A, B, or C, it is possible to adjust the film surface temperature after the ink drying treatment into the range of the film surface temperature after the ink drying treatment in which the blocking performance becomes A, B, or C by feedback-controlling the treatment temperature in the ink drying treatment.

Similarly, in a case in which the paper ejection temperature is monitored, and the paper ejection temperature is not in a range of the paper ejection temperature in which the blocking performance becomes A, B, or C, it is possible to adjust the paper ejection temperature into the range of the paper ejection temperature in which the blocking performance becomes A, B, or C by feedback-controlling the treatment temperature in the post treatment of varnish after the varnish application.

The feedback control may be applied to at least any one of the film surface temperature after the ink drying treatment and the paper ejection temperature.

Instead of the feedback control, the spraying of powder can be applied. In a case in which powder is not sprayed, it is possible to set the blocking performance to A, B, or C by spraying powder.

In a case in which powder is sprayed, it is possible to set the blocking performance to A, B, or C by increasing the amount of the powder sprayed. The amount of the powder sprayed needs to be 0.01 gram or more per sheet of paper.

In a case in which the film surface temperature after the ink drying treatment or the paper ejection temperature at which desired stickiness is realized is derived in advance, the previously-derived film surface temperature after the ink drying treatment or paper ejection temperature is set.

In a case in which the film surface temperature after the ink drying treatment or the paper ejection temperature at which desired stickiness is realized is not derived in advance, the film surface temperature after the ink drying treatment or the paper ejection temperature at which desired stickiness is realized is actually measured, and the actually-measured film surface temperature after the ink drying treatment or paper ejection temperature is set.

According to Test 38 illustrated in FIG. 13, the film surface temperature after the ink drying treatment at which desired stickiness is realized is 100° C. or higher. In addition, according to Tests 33 and 35 illustrated in FIG. 13, the paper ejection temperature at which desired stickiness is realized is 35° C. or lower.

In the stickiness evaluation of varnish illustrated in FIGS. 11 to 13, the ink and the treatment liquid are not limited to the above-described examples as long as an appropriate amount of varnish is applied. With ink and treatment liquid which are ink and treatment liquid capable of the application of varnish and can be applied to ink jet-type printing, the same evaluation results can also be obtained.

An appropriate amount of varnish applied is 2.0 gram or more and 6.0 gram or less per square meter. A more preferred amount of varnish applied is 3.5 gram or more and 4.5 gram or less per square meter.

<Regarding Difference in Kinds of Varnish and Stickiness Evaluation>

FIG. 16 is a table showing the evaluation results of stickiness evaluation in the offline-type varnish application in a case in which the kind of the varnish is changed and illustrates the evaluation results of evaluation tests to which the same conditions as those in Tests 1 through 7 illustrated in FIG. 11 are applied.

In Tests 101 through 107 illustrated in FIG. 16, HYDLITH2019 manufactured by DIC Graphics Corporation is applied as the varnish. In the product catalog of DIC Graphics Corporation, HYDLITH2012-R1 is described as standard-type aqueous varnish. In addition, in the product catalog of the same company, HYDLITH2019 is described as aqueous varnish for exclusive use of cardboard.

When Tests 101 through 107 illustrated in FIG. 16 and Tests 1 through 7 illustrated in FIG. 11 are compared with each other, although the stickiness evaluation values are different from each other except for a combination of Test 5 and 105 and a combination of Tests 6 and 106, the same blocking performance is obtained in all of the combinations.

FIG. 17 is a table showing the evaluation results of stickiness evaluation in the online-type varnish application in a case in which the kind of the varnish is changed and illustrates the evaluation results of evaluation tests to which the same conditions as those in Tests 11 through 25 illustrated in FIG. 12 are applied.

When Tests 111 through 125 illustrated in FIG. 17 and Tests 11 through 25 illustrated in FIG. 12 are compared with each other, although the stickiness evaluation values are different from each other except for a combination of Test 14 and 114, a combination of Test 15 and 115, a combination of Tests 20 and 120, and a combination of Test 21 and 121, the same blocking performance is obtained in all of the combinations.

FIG. 18 is a table showing the evaluation results of stickiness evaluation in the inline-type varnish application in a case in which the kind of the varnish is changed and illustrates the evaluation results of evaluation tests to which the same conditions as those in Tests 31 through 42 illustrated in FIG. 13 are applied.

When Tests 131 through 142 illustrated in FIG. 18 and Tests 31 through 42 illustrated in FIG. 13 are compared with each other, although the stickiness evaluation values are different from each other except for a combination of Test 32 and 132, a combination of Test 33 and 133, a combination of Tests 35 and 135, a combination of Tests 36 and 136, a combination of Tests 37 and 137, a combination of Tests 38 and 138, and a combination of Test 40 and 140, the same blocking performance is obtained in all of the combinations.

Meanwhile, the blocking performance is evaluated as B in Test 134 illustrated in FIG. 18, and the blocking performance is evaluated as A in Test 34 illustrated in FIG. 13. In a case in which the blocking performance is evaluated as B, although blocking occurs, the blocking is in a range permissible in terms of image qualities, and the blocking performance is evaluated as the same level as in a case in which the blocking performance is evaluated as A in which blocking does not occur.

The summary of what has been described above shows that, regarding the blocking performance, the evaluation results of the stickiness evaluation in the varnish application illustrated in FIGS. 16 to 18 are the same results as the evaluation results of the stickiness evaluation in the varnish application illustrated in FIGS. 11 to 13.

The aqueous varnish used for the stickiness evaluation in the varnish application illustrated in FIGS. 11 to 13 and the aqueous varnish used for the stickiness evaluation in the varnish application illustrated in FIGS. 16 to 18 have different applications and functions. On the other hand, both aqueous varnishes obtain the same evaluation result regarding stickiness in varnish application.

In such a case, it can be considered that, even for other aqueous varnish having different applications and functions from those of the aqueous varnish used for the stickiness evaluation in the varnish application illustrated in FIGS. 11 to 13 and the aqueous varnish used for the stickiness evaluation in the varnish application illustrated in FIGS. 16 to 18, the same evaluation result regarding stickiness in varnish application can be obtained.

[Description of Ink]

<SP Value>

FIGS. 14 and 15 are explanatory views of ink solvents. FIGS. 14 and 15 illustrate the SP values, the molecular weights, and the structures of solvents that are applicable as the solvents in the ink. The SP value is a value expressed by the square root of the molecular agglomeration energy and can be computed using the method described in R. F. Fedors, Polymer Engineering Science, 14, p 147 (1974). The unit is (MPa)1/2 and the SP value refers to a value at 25° C. M represents $10^6$.

In addition, the content of water-soluble organic solvents can be quantitatively measured using an analysis method such as liquid chromatography. Meanwhile, the SP value is called a solubility parameter in some cases. SP is the abbreviation of solubility parameter indicating the solubility parameter.

The SP value of the solvent in the ink is preferably 25 $(MPa)^{1/2}$ or more. In other words, to the ink, it is preferable to apply hydrophilic solvents. Solvents having a relatively large SP value are hydrophilic. Solvents having a relatively small SP value are hydrophobic.

In a case in which the solvent in the ink is hydrophobic, the solvent acts as a plasticizer with respect to varnish. In such a case, varnish is likely to stick. Therefore, the use of hydrophilic solvents in the ink suppresses the stickiness of varnish.

<Molecular Weight>

The molecular weight of the solvent in the ink is preferably 100 or less. Solvents having a large molecular weight are not easily removable from films of ink. When solvents are not easily removable from films of ink, the solvents in the ink are likely to mix into varnish during the application of the varnish. Therefore, the solvent in the ink is preferably a solvent having a low molecular weight of 100 or less.

Among the solvents illustrated in FIGS. 14 and 15, solvents containing glycerine, polyethylene glycol, and the like are examples of preferred solvents in the ink. As the molecular weight, it is possible to apply weight-average molecular weight. The measurement of weight-average molecular weight will be described below.

<Formulation Examples of Ink>

The formulations of the magenta ink and the cyan ink applied to the previously-described stickiness evaluation are as described below.

Cyan ink

Cyan pigment: 2.5 mass percent

Glycerin: 2.5 mass percent

MFTG: 2.0 mass percent

PG: 14.5 mass percent

Carnauba wax (SELOSOL 524 manufactured by Chukyo Yushi Co, Ltd.): 2.0 mass percent Self-dispersive polymer fine particles: 8.8 mass percent Ion-exchanged water: the remaining amount with which the total amount reaches 100 mass percent Examples of the self-dispersive polymer fine particles include acrylic latex. MFTG is the abbreviation of methyl propylene tri glycol. PG is the abbreviation of propylene glycol.

Magenta Ink

Magenta pigment: 6.6 mass percent

Glycerin: 2.5 mass percent

MFTG: 2.0 mass percent

PG: 14.4 mass percent

Carnauba wax (SELOSOL 524 manufactured by Chukyo Yushi Co, Ltd.): 2.0 mass percent Self-dispersive polymer fine particles: 5.1 mass percent Ion-exchanged water: the remaining amount with which the total amount reaches 100 mass percent <Formulation Example of Treatment Liquid>

The formulation of the treatment liquid applied to the previously-described stickiness evaluation is as described below.

Malonic acid: 9.0 mass percent 1,2,3-propantricarboxylic acid: 2.4 mass percent

DL-malic acid: 7.7 mass percent

Phosphoric acid (85 percent): 6.7 mass percent

Diethylene glycol monobutyl ether: 4.8 mass percent

Tripropylene glycol monomethyl ether: 4.8 mass percent

Benzotriazole: 1.2 mass percent

Ion-exchanged water: the remaining amount with which the total amount reaches 100 mass percent <Description of Composition of Ink>

Next, the composition of the ink will be described. An ink composition in the following description can be equivalently referred to as ink.

The ink composition includes a pigment and can be configured further using a dispersant, a surfactant, and other components as necessary. Meanwhile, when the viscosity or surface tension of ink liquid is increased in order to improve the resistance of images, it is also possible to suppress the spread of the ink on recording media. For example, when the amount of dispersive particle components such as a pigment or resin particles out of components described below is increased, it is possible not only to increase the viscosity of the ink liquid but also to expect the strength of agglomerates to be improved by accelerating agglomeration, which is preferable.

<Pigment>

The ink composition contains at least one kind of pigment as a color material component. The pigment is not particularly limited, can be appropriately selected depending on the purposes, and may be any one of, for example, an organic pigment or an inorganic pigment. The pigment is preferably a pigment that is barely or poorly soluble in water from the viewpoint of ink-coloring properties.

<Dispersant>

The ink composition may contain at least one kind of dispersant. The dispersant for the pigment may be any one of a polymer dispersant or a low-molecular-weight surfactant-type dispersant. In addition, the polymer dispersant may be any one of a water-soluble dispersant or a water-insoluble dispersant.

The weight-average molecular weight of the polymer dispersant is preferably 3,000 to 100,000, more preferably 5,000 to 50,000, still more preferably 5,000 to 40,000, and particularly preferably 10,000 to 40,000. Meanwhile, in the present specification, in a case in which an arbitrary value is represented by A and an arbitrary value different from A is represented by B, A to B is expressed by A or more and B or less.

The acid value of the polymer dispersant is preferably 100 mgKOH/g or less from the viewpoint of favourable agglomeration properties when the treatment liquid comes into contact with the polymer dispersant. Furthermore, the acid value is more preferably 25 to 100 mgKOH/g, still more preferably 25 to 80, and particularly 30 to 65. When the acid value of the polymer dispersant is 25 or more, the stability of self dispersibility becomes favourable. Meanwhile, mgKOH/g is the mass of potassium hydroxide necessary to neutralize free aliphatic acids present in one gram of fat and oil. The mass of potassium hydroxide is expressed using milligrams.

The polymer dispersant preferably includes a polymer having a carboxyl group and more preferably includes a polymer having a carboxyl group and an acid value of 25 to 80 mgKOH/g from the viewpoint of self dispersibility and the agglomeration rate when treatment liquid comes into contact with the polymer dispersant.

From the viewpoint of the light fastness, qualities, and the like of images, the ink composition preferably includes the pigment and the dispersant, more preferably includes an organic pigment and the polymer dispersant, and particularly preferably includes an organic pigment and a polymer dispersant including a carboxyl group. In addition, from the viewpoint of agglomeration properties, preferably, the pigment is coated with the polymer dispersant having a carboxyl group and is water-insoluble. Furthermore, from the viewpoint of agglomeration properties, the acid value of the particles of a self-dispersive polymer described below is preferably smaller than the acid value of the polymer dispersant.

The average particle diameter of the pigment is preferably 10 to 200 nanometers, more preferably 10 to 150 nanometers, and still more preferably 10 to 100 nanometers. When the average particle diameter is 200 nanometers or less, color reproducibility becomes favourable and the jetting properties during jetting using an ink jet method become favourable, and, when the average particle diameter is 10 nanometers or more, the light fastness becomes favorable. In addition, the particle size distribution of the color material is not particularly limited and may be any one of a wide particle size distribution or a monodispersive particle size distribution. In addition, two or more kinds of color materials having a monodispersive particle size distribution may be used in a mixed form.

Meanwhile, the average particle diameter and the particle size distribution of pigment particles are obtained by measuring the volume-average particle diameters using a nanotrac particle size distribution measurement apparatus UPA-EX150 (manufactured by Nikkiso Co., Ltd.) and a dynamic light scattering method.

The pigment may be used singly or two or more kinds of pigments may be used in combination.

From the viewpoint of image densities, the content of the pigment in the ink composition is preferably 1 to 25 mass percent, more preferably 2 to 20 mass percent, still more preferably 5 to 20 mass percent, and particularly preferably 5 to 15 percent of the ink composition.

<Polymer Particles>

The ink composition may contain at least one kind of polymer particles. These polymer particles have a function of fixing the ink composition by making dispersion unstable, agglomerating, and increasing the viscosity of the ink when the polymer particles come into contact with a treatment liquid described below or a region in which the treatment liquid is dried and is capable of further improving the fixing properties of the ink composition to recording media and the rub resistance of images.

In order to react with an agglomerating agent, polymer particles having anionic surface charges are used, a widely and generally-known latex is used in a range in which sufficient reactivity and jetting stability can be obtained, and, particularly, self-dispersive polymer particles are preferably used.

<Self-Dispersive Polymer Particles>

The ink composition preferably contains at least one kind of self-dispersive polymer particles as the polymer particles. These self-dispersive polymer particles have a function of fixing the ink composition by making dispersion unstable, agglomerating, and increasing the viscosity of the ink when the self-dispersive polymer particles come into contact with the treatment liquid described below or a region in which the treatment liquid is dried and is capable of further improving the fixing properties of the ink composition to recording media and the rub resistance of images. In addition, the self-dispersive polymer is also preferred resin particles from the viewpoint of jetting stability and liquid stability (particularly dispersion stability) of systems including the pigment.

The particles of the self-dispersive polymer refer to the particles of a water-insoluble polymer which can fall into a dispersion state in aqueous media in the absence of other surfactants using functional groups (particularly, acidic groups or salts thereof) the polymer has and a water-insoluble polymer not containing a free emulsifier.

From the viewpoint of favourable agglomeration properties when the treatment liquid comes into contact with the self-dispersive polymer, the acid value of the self-dispersive polymer is preferably 50 mgKOH/g or less. Furthermore, the acid value is more preferably 25 to 50 mgKOH/g and still more preferably 30 to 50. When the acid value of the self-dispersive polymer is 25 or more, the stability of self dispersibility becomes favorable.

From the viewpoint of self dispersibility and agglomeration rates when the treatment liquid comes into contact with the particles of the self-dispersive polymer, the particles of the self-dispersive polymer preferably include a polymer having a carboxyl group, more preferably include a polymer having a carboxyl group and an acid value of 25 to 50 mgKOH/g, and still more preferably include a polymer having a carboxyl group and an acid value of 30 to 50 mgKOH/g.

As the molecular weight of the water-insoluble polymer configuring the particles of the self-dispersive polymer, the weight-average molecular weight is preferably 3,000 to 200,000, more preferably 5,000 to 150,000, and still more preferably 10,000 to 100,000. When the weight-average molecular weight is set to 3,000 or more, it is possible to effectively suppress the amount of water-soluble components. In addition, when the weight-average molecular weight is set to 200,000 or less, it is possible to enhance the self-dispersion stability.

Meanwhile, the weight-average molecular weight is measured by means of gel permeation chromatography (GPC). In GPC, HLC-8220GPC (manufactured by Tosoh Corporation) is used, three columns of TSKgeL Super HZM-H, TSKgeL Super HZ4000, and TSKgeL Super HZ2000 (manufactured by Tosoh Corporation, 4.6 mmID×15 cm) are used as columns, and tetrahydrofuran (THF) is used as an eluent. In addition, as the conditions, the specimen concentration is set to 0.35 per minute, the flow rate is set to 0.35 milliliters per minute, the sample injection amount is set to 10 microliters, the measurement temperature is set to 40° C., and an IR detector is used. In addition, the calibration curve is produced from eight samples of "standard specimen TSK standard, polystyrene" manufactured by Tosoh Corporation: "F-40", "F-20", "F-4", "F-1", "A-5000", "A-2500", "A-1000", and "n-propylbenzene".

The average particle diameter of the particles of the self-dispersive polymer is preferably in a range of 10 nanometers to 400 nanometers, more preferably in a range of 10 to 200 nanometers, and still more preferably in a range of 10 to 100 nanometers in terms of the volume-average particle diameter. When the volume-average particle diameter is 10 nanometers or more, manufacturing suitability improves, and, when the volume-average particle diameter is 1 micrometer or less, storage stability improves.

Meanwhile, the average particle diameter and the particle size distribution of the particles of the self-dispersive polymer are obtained by measuring the volume-average particle diameters using a nanotrac particle size distribution measurement apparatus UPA-EX150 (manufactured by Nikkiso Co., Ltd.) and a dynamic light scattering method.

One kind of the particles of the self-dispersive polymer can be used singly or two or more kinds of the particles can be used in a mixed form. The content of the particles of the self-dispersive polymer in the ink composition is preferably 1 to 30 mass percent and more preferably 5 to 15 mass percent of the ink composition from the viewpoint of agglomeration rates, the glossiness of images, and the like.

In addition, the content ratio of the pigment in the ink composition to the particles of the self-dispersive polymer (for example, water-insoluble pigment particles/the particles of the self-dispersive polymer) is preferably 1/0.5 to 1/10 and more preferably 1/1 to 1/4 from the viewpoint of the rub resistance of images and the like.

The ink composition may contain at least one kind of a water-soluble organic solvent. The water-soluble organic solvent is capable of producing an effect of drying prevention, moistening, or permeation acceleration. For drying prevention, the water-soluble organic solvent is used as an anti-drying agent that prevents ink from being attached to and dried at ink ejection openings of spraying nozzles, which generates agglomerates and causes clogging, and, for drying prevention or moistening, water-soluble organic solvents having a lower vapour pressure than water are preferred. In addition, for permeation acceleration, the water-soluble organic solvent can be used as a permeation enhancer that enhances ink permeation properties into paper.

As the anti-drying agent, water-soluble organic solvents having a lower vapour pressure than water are preferred.

One kind of the anti-drying agent may be used singly or two or more kinds of anti-drying agents may be jointly used. The content of the anti-drying agent is preferably set in a range of 10 to 50 mass percent of the ink composition.

As a permeation enhancer, the water-soluble organic solvent is preferred for the purpose of more favorably permeating the ink composition into paper. One kind of the permeation enhancer may be used singly or two or more kinds of permeation enhancer may be jointly used. The content of the permeation enhancer is preferably set in a range of 5 to 30 mass percent of the ink composition. In addition, the permeation enhancer is preferably used in an amount in which bleeding of images and print through do not occur.

<Water>

The ink composition contains water, but the amount of the water is not particularly limited. Among these, the content of the water is preferably 10 to 99 mass percent, more preferably 30 to 80 mass percent, and still more preferably 50 to 70 mass percent.

<Other Additives>

The ink composition can be configured using additives other than the above-described components. Examples of the other additives include well-known additives such as an anti-drying agent (wetting agent), a discoloration preventor, an emulsification stabilizer, an permeation enhancer, an ultraviolet absorbent, a preservative agent, a fungicide, a pH adjuster, a surface tension adjuster, a defoamer, a viscosity adjuster, a dispersant, a dispersion stabilizer, a rust inhibitor, and a chelating agent.

<Regarding Difference in Solvent in Ink and Stickiness Evaluation>

FIG. 19 is a table showing the kind of a solvent in ink, the content of the solvent in the ink, the SP value of the solvent in the ink, and the molecular weight of the solvent in the ink in Test 33 of FIG. 13. In the ink applied to Test 33 illustrated in FIGS. 13 and 19, polyethylene glycol is used as the solvent in the ink. The content of the polyethylene glycol is 14.5 mass percent. In addition, the SP value of the polyethylene glycol is 32.55 $(MPa)^{1/2}$, and the molecular weight of the polyethylene glycol is 76. Meanwhile, PG in Test 33 represents polyethylene glycol. In addition, mass % indicates mass percent.

FIG. 20 is a table showing the evaluation results of stickiness evaluation in the varnish application in cases in which the solvent in the ink is changed in Test 33 of FIG. 13. The ink applied to Test 51 illustrated in FIG. 20 includes 14.5 mass percent of ethylene glycol. The SP value of the ethylene glycol is 36.48 $(MPa)^{1/2}$, and the molecular weight of the ethylene glycol is 60. In Test 51, the stickiness evaluation in varnish application is evaluated as A. Meanwhile, EG in Test 51 represents ethylene glycol.

The ink applied to Test 52 includes 14.5 mass percent of 1,3-butanediol. The SP value of the 1,3-butanediol is 30.27 $(MPa)^{1/2}$, and the molecular weight of the 1,3-butanediol is 90.12. Meanwhile, BDO in Test 52 represents butanediol.

The ink applied to Test 53 includes 14.5 mass percent of 2-pyrrolidone. The SP value of the 2-pyrrolidone is 25.85 $(MPa)^{1/2}$, and the molecular weight of the 2-pyrrolidone is 85.1. In Tests 52 and 53 illustrated in FIG. 20, the stickiness evaluation in varnish application is evaluated as B.

The ink applied to Test 54 includes 14.5 mass percent of GP-250. Meanwhile, GP-250 is a trade name. The SP value of the GP-250 is 26.38 $(MPa)^{1/2}$, and the molecular weight of the GP-250 is 250.

The ink applied to Test 55 includes 14.5 mass percent of diethylene glycol. The SP value of the diethylene glycol is 30.62 $(MPa)^{1/2}$, and the molecular weight of the diethylene glycol is 106. Meanwhile, DEG in Test 55 represents diethylene glycol.

The ink applied to Test 56 includes 14.5 mass percent of dipropylene glycol. The SP value of the dipropylene glycol is 27.14 $(MPa)^{1/2}$, and the molecular weight of the dipropylene glycol is 134.17. Meanwhile, DPG in Test 56 represents dipropylene glycol. In Tests 54 through 56, the stickiness evaluation in varnish application is evaluated as C.

The ink applied to Test 57 includes 14.5 mass percent of diethylene glycol monobutyl ether. The SP value of the diethylene glycol monobutyl ether is 21.51 $(MPa)^{1/2}$, and the molecular weight of the diethylene glycol monobutyl ether is 162.23. Meanwhile, DEGmBE in Test 57 represents diethylene glycol monobutyl ether.

The ink applied to Test 58 includes 14.5 mass percent of tripropylene glycol monomethyl ether. The SP value of the tripropylene glycol monomethyl ether is 20.43 $(MPa)^{1/2}$, and the molecular weight of the tripropylene glycol monomethyl ether is 206. Meanwhile, TPGmME in Test 58 represents tripropylene glycol monomethyl ether. In Tests 57 and 58, the stickiness evaluation in varnish application is evaluated as D.

The summary of what has been described above shows that, in the varnish application of the ink containing a solvent having an SP value of 25 or more and a molecular weight of 100 or less, the blocking performance is evaluated as A or B. Preferred blocking performance can be obtained due to the use of ink containing a solvent having an SP value of 25 or more and a molecular weight of 100 or less.

In addition, in the varnish application of the ink containing a solvent having an SP value of 25 or more and a molecular weight of 250 or less, the blocking performance is evaluated as C. Blocking performance in a range permissible under conditions of studying operation methods can be obtained due to the use of ink containing a solvent having an SP value of 25 or more and a molecular weight of 250 or less.

Meanwhile, according to the evaluation results illustrated in FIGS. 19 and 20, the SP value of the solvent in the ink in which the blocking performance is evaluated as A, B, or C is 25.85 or more. In addition, the SP value at which the blocking performance is evaluated as D, is 21.51 or less. The boundary value of the SP value is a value that is greater than 21.51 and is considered to be a value of 25.85 or less. Therefore, 25 which is an integer of 25.85 or lower and an integer the difference from 25.85 of which is minimized is determined as the boundary value of the SP value.

[Description of Treatment Liquid]

The treatment liquid includes at least an agglomerating agent that agglomerates the above-described components in the ink composition and can be configured further using other components as necessary. When the treatment liquid is used, it is possible to increase the speed of ink jet-type printing and obtain images having a high density and a high definition and having excellent printing properties (for example, properties of reproducing fine lines or fine portions) even when the images are printed at a high speed. In addition, when the formulation of the treatment liquid or the ink composition is improved, it is possible to increase the strength of formed images and reinforce the durability of images by blowing high-pressure wind.

The agglomerating agent may be a compound capable of changing the pH value of the ink composition, a polyvalent metal salt, or polyallyamines. From the viewpoint of the agglomerating properties of the ink composition, a compound capable of changing the pH value of the ink composition is preferred, and a compound capable of lowering the pH value of the ink composition is more preferred.

An agglomerating agent capable of rapidly separating solid-form components and deposited components (liquid components) after agglomeration or capable of further rigidifying agglomerates is preferably selected. The above-described agglomerating agent is preferably an organic acid, more preferably di- or higher-valent organic acid, and particularly preferably di- or higher-valent and tri- or lower-valent acidic substance. The di- or higher-valent organic acid is preferably an organic acid having a first pKa of 3.5 or lower and more preferably an organic acid having a first pKa of 3.0 or lower. Specific examples thereof preferably include phosphoric acid, oxalic acid, malonic acid, citric acid, and the like.

The agglomeration agent can be used singly or two or more kinds of agglomerating agents can be used in a mixed form.

The content of the agglomerating agent that agglomerates the ink composition in the treatment liquid is preferably 1 to 50 mass percent, more preferably 3 to 45 mass percent, and still more preferably in a range of 5 to 40 mass percent.

The treatment liquid may further contain other additives as additional components as long as the effects are not impaired. Examples of the other additives include well-known additives such as an anti-drying agent (wetting agent), a discoloration preventor, an emulsification stabilizer, a permeation enhancer, an ultraviolet absorbent, a preservative agent, a fungicide, a pH adjuster, a surface tension adjuster, a defoamer, a viscosity adjuster, a dispersant, a dispersion stabilizer, a rust inhibitor, and a chelating agent. Meanwhile, pH represents the concentration of hydrogen ions. pH is pronounced as pe-ha- or pi-eichi in some cases.

As the ink, ink which can be ejected in a liquid droplet state using ink jet heads such as ink containing metallic particles or ink containing resin particles is applicable.

[Description of Actions and Effects]

According to the ink jet printing system and the method for applying varnish which are configured as described above, stickiness in paper coated with varnish is suppressed by carrying out at least any one treatment of an ink drying treatment to which ink drying conditions under which the stickiness evaluation value reaches 0.24 or less are applied and a varnish post treatment to which varnish post treatment conditions under which the stickiness evaluation value reaches 0.24 or less are applied.

Hitherto, there have been no examples in which blocking is improved by paying attention to the stickiness of varnish which indicates the surface properties of varnish.

When at least any one treatment of an ink drying treatment to which ink drying conditions under which the stickiness evaluation value reaches less than 0.20 are applied and a varnish post treatment to which varnish post treatment conditions under which the stickiness evaluation value reaches less than 0.24 are applied, stickiness in paper coated with varnish is further suppressed.

As the ink drying conditions under which the stickiness evaluation value reaches less than 0.20, ink drying conditions under which the surface temperature of images printed on paper which has been subjected to the ink drying treatment reaches 100° C. or higher are applicable.

As the varnish post treatment conditions under which the stickiness evaluation value reaches less than 0.20, varnish post treatment conditions under which the surface temperature of varnish applied to paper which has been subjected to the varnish post treatment reaches 35° C. or lower are applicable. Examples of the varnish post treatment include a cooling treatment. As the cooling treatment, cooling of the surface by which paper is supported during varnish application is applicable.

As the conditions under which the stickiness evaluation value reaches 0.24 or less, conditions under which the period from the end of the ink drying treatment through the beginning of varnish application is five minutes or longer are applicable. As the conditions under which the stickiness evaluation value reaches less than 0.20, conditions under which the period from the end of the ink drying treatment through the beginning of varnish application is ten minutes or longer are applicable.

Examples of conditions under which the stickiness evaluation value reaches 0.24 or less include conditions under which the heating temperature is 50° C. and the heating period of 60 seconds or longer in the heating treatment of paper after the ink drying treatment. Examples of conditions under which the stickiness evaluation value reaches less than 0.20 include conditions under which the heating temperature is 60° C. and the heating period of 10 seconds or longer in the heating treatment of paper after the ink drying treatment.

Examples of conditions under which the stickiness evaluation value reaches 0.24 or less include the spraying of powder after varnish application. Examples of conditions under which the stickiness evaluation value reaches less than 0.20 include an increase in the amount of powder sprayed in the spraying of the powder after varnish application.

In the embodiment of the present invention described above, configuration elements can be appropriately modified, added, and removed within the scope of the gist of the present invention. The present invention is not limited to the above-described embodiment and can be modified in various manners by persons having ordinary knowledge in the corresponding field within the scope of the technical concept of the present invention.

EXPLANATION OF REFERENCES

1: ink jet printing device
10: paper feeding portion
11: paper feeding device
12: feeder board
13: paper feeding drum
20: treatment liquid application portion
21: treatment liquid application drum
22: treatment liquid application device
30: treatment liquid drying portion
31: treatment liquid drying drum
32: first paper guide
33: dryer
40: printing portion
41: printing drum
42: paper pressing roller
43, 43C, 43M, 43Y, 43K: ink jet head
44: scanner
50: ink drying portion
51: first chain delivery
52: second paper guide
53: first heating device
60: varnish application portion
61: varnish application drum
70: varnish post treatment portion
70A: second heating device
71: second chain delivery
72: third paper guide
80: accumulation portion
81: accumulation device
90: varnish coater
92: first temperature detection portion
94: second temperature detection portion
96: powder spraying portion
100: computer
101: communication portion
102: operation portion
103: display portion
104: storage portion
105: transport portion
106: communication portion
110: transport control portion
111: paper feeding control portion
112: treatment liquid application control portion
113: treatment liquid drying control portion
114: printing control portion
115: ink drying control portion
116: varnish application control portion
117: varnish post treatment control portion
118: accumulation control portion
120: communication control portion
130: powder spraying control portion
132: first temperature information acquisition portion
134: drying condition setting portion
136: second temperature information acquisition portion
138: varnish post treatment condition setting portion
140: image processing portion
200: ink jet printing system
300: ink jet printing device
400: varnish application device
410: paper feeding portion
411: paper feeding device
412: feeder board
413: paper feeding drum
460: varnish application portion
461: varnish application drum
470: varnish post treatment portion
470A: second heating device
471: second chain delivery
472: third paper guide
480: accumulation portion
481: accumulation device
490: varnish coater
494: second temperature detection portion
496: powder spraying portion
700: ink jet printing system
710: transfer device
712: conveyor
800: stickiness measurement device
802: specimen table
804: cylinder edge
806: pendulum
808: detector
810: magnet
820: damped vibration curve
840: curve
842: converged value
850: curve
852: maximum value
P: paper
S10 to S32: individual steps of method for applying varnish

What is claimed is:

1. An image-forming device, comprising:

a medium transport portion that transports media in a medium transport direction;

a printing portion that forms images on the media being transported using ink;

a varnish application portion that applies aqueous varnish to the media on which the images are formed;

a treatment portion that is configured to perform a treatment on the media so that a stickiness evaluation value reaches 0.24 or less, which is the stickiness evaluation value indicating a degree of stickiness of the aqueous varnish applied to the media when the media to which the aqueous varnish is applied are output from the varnish application portion and being derived using a damped vibration percentage of a pendulum caused to do pendulum motions from an arbitrary location of the media where the aqueous varnish is applied, wherein the arbitrary location of the media is used as a pivot for the pendulum to perform the pendulum motions; and an accumulation portion that accumulates the media to which the aqueous varnish is applied using the varnish application portion and on which the treatment is performed using the treatment portion; and a first temperature detection portion which is disposed at a location on a downstream side of the printing portion in the medium transport direction and at a location on an upstream side of the varnish application portion in the medium transport direction and detects temperatures of the media on which the images are formed using the printing portion and the aqueous varnish is to be applied using the varnish application portion, wherein the treatment portion includes:

a drying treatment portion which is disposed at a location on the downstream side of the printing portion in the medium transport direction and at a location on the upstream side of the varnish application portion in the medium transport direction and is configured to perform a drying treatment on the media on which the images are formed using the printing portion and the aqueous varnish is to be applied using the varnish application portion and a drying treatment control portion that controls temperatures of the media on which the drying treatment is performed using the drying treatment portion by applying drying conditions under which the stickiness evaluation value of the media to which the aqueous varnish is to be applied using the varnish application portion reaches 0.24 or less; and a powder spraying portion that sprays powder to the media treated using the treatment portion, and a powder spraying control portion that sprays powder to the media treated using the treatment portion using the powder spraying portion in a case in which the temperatures of the media detected using the first temperature detection portion are lower than 101° C.

2. The image-forming device according to claim 1, wherein the treatment portion is configured to perform a treatment on the media so that the stickiness evaluation value reaches less than 0.20.

3. The image-forming device according to claim 1, wherein the drying treatment control portion controls an operation of the drying treatment portion by applying the drying conditions under which the temperatures of the media which are detected using the first temperature detection portion reach 101° C. or higher.

4. The image-forming device according to claim 1, further comprising a second temperature detection portion which is disposed at a location on the downstream side of the varnish application portion in the medium transport direction and at a location on the upstream side of the accumulation portion in the medium transport direction and detects temperatures of the media on which the aqueous varnish is applied using the varnish application portion and which are to be accumulated in the accumulation portion, wherein the treatment portion further includes a cooling treatment portion which is disposed at a location on the downstream side of the varnish application portion in the medium transport direction and at a location on the upstream side of the accumulation portion in the medium transport direction and is configured to perform a cooling treatment on the media to which the varnish is applied using the varnish application portion and a cooling treatment control portion that controls temperatures of the media on which the cooling treatment is performed with the cooling treatment portion by applying cooling conditions under which the stickiness evaluation value of the media to which the aqueous varnish is to be applied using the varnish application portion reaches less than 0.24.

5. The image-forming device according to claim 4, wherein the cooling treatment control portion controls operation of the cooling treatment portion by applying cooling conditions under which the temperatures of the media which are detected using the second temperature detection portion reach 40° C. or lower.

6. The image-forming device according to claim 4, wherein the treatment portion includes a powder spraying portion that sprays powder to the media treated using the treatment portion and a powder spraying control portion that sprays powder to the media treated using the treatment portion using the powder spraying portion in a case in which the temperatures of the media detected using the second temperature detection portion exceeds 40° C.

7. The image-forming device according to claim 1, wherein the treatment portion includes a transfer treatment portion that transfers the media on which the images are formed using the printing portion and to which the varnish is to be applied in the varnish application portion and a transfer condition setting portion that sets conditions under which an environment temperature is 15° C. or higher and 35° C. or lower, an environmental relative humidity is 35 percent or higher and 65 percent or lower, and a transfer period is ten minutes or longer as transfer conditions in the transfer treatment portion.

8. The image-forming device according to claim 1, wherein the treatment portion includes a transfer treatment portion that transfers the media on which the images are formed using the printing portion and to which the varnish is to be applied in the varnish application portion and a transfer condition setting portion that sets conditions under which an environment temperature is 50° C. or higher and a transfer period is 90 seconds or longer as transfer conditions in the transfer treatment portion.

9. The image-forming device according to claim 1, wherein the treatment portion includes a transfer treatment portion that transfers the media on which the images are formed using the printing portion and to which the varnish is to be applied in the varnish application portion and a transfer condition setting portion that sets conditions under which an environment temperature is 60° C. or higher and a transfer period is ten seconds or longer as transfer conditions in the transfer treatment portion.

10. The image-forming device according to claim 1, wherein the ink contains a solvent having an SP value of 25 $(MPa)^{1/2}$ or more.

11. The image-forming device according to claim 1, wherein the ink contains a solvent having a molecular weight of 100 or less.

12. A method for applying varnish, comprising:

a printing step of forming images on media using ink;

a varnish application step of applying aqueous varnish to the media using the printing step using a varnish application portion after the printing step;

a treatment step of performing a treatment on the media so that a stickiness evaluation value reaches 0.24 or less, which is the stickiness evaluation value indicating a degree of stickiness of the aqueous varnish applied to the media when the media to which the aqueous varnish is applied in the varnish application step are output from the varnish application portion and being derived using a damped vibration percentage of a pendulum caused to do pendulum motions from an arbitrary location of the media where the aqueous varnish is applied, wherein the arbitrary location of the media is used as a pivot for the pendulum to perform the pendulum motions;

an accumulation step of accumulating the media after the varnish application step and the treatment step; and a temperature detection step of detecting temperatures of the media after the printing step and prior to the varnish application step, wherein the treatment step includes:

a drying treatment step of performing a drying treatment on the media after the printing step and prior to the varnish application step, and a drying treatment control step of controlling temperatures of the media on which the drying treatment is performed in the drying treatment step by applying drying conditions under which the stickiness evaluation value of the media to which the aqueous varnish is to be applied in the varnish application step reaches 0.24 or less; and a powder spraying step of spraying powder to the media treated in the treatment step, and a powder spraying control step of spraying powder to the media treated in the powder spraying step in a case in which the temperatures of the media detected in the temperature detection step are lower than 101° C.

13. An image-forming device, comprising:

a medium transport portion that transports media in a medium transport direction;

a printing portion that forms images on the media being transported using ink;

a varnish application portion that applies aqueous varnish to the media on which the images are formed;

a treatment portion that is configured to perforin a treatment on the media so that a stickiness evaluation value reaches 0.24 or less, which is the stickiness evaluation value indicating a degree of stickiness of the aqueous varnish applied to the media when the media to which the aqueous varnish is applied are output from the varnish application portion and being derived using a damped vibration percentage of a pendulum caused to do pendulum motions from an arbitrary location of the media where the aqueous varnish is applied, wherein the arbitrary location of the media is used as a pivot for the pendulum to perform the pendulum motions;

an accumulation portion that accumulates the media to which the aqueous varnish is applied using the varnish application portion and on which the treatment is performed with the treatment portion; and a temperature detection portion that is disposed at a location on a downstream side of the varnish application portion in the medium transport direction and at a location on an upstream side of the accumulation portion in the medium transport direction and detects temperatures of the media on which the aqueous varnish is applied using the varnish application portion and which are to be accumulated in the accumulation portion, wherein the treatment portion includes:

a cooling treatment portion that is disposed at a location on the downstream side of the varnish application portion in the medium transport direction and at a location on the upstream side of the accumulation portion in the medium transport direction and is configured to perform a cooling treatment on the media to which the varnish is applied using the varnish application portion, and a cooling treatment control portion that controls temperatures of the media on which the cooling treatment is performed with the cooling treatment portion by applying cooling conditions under which the stickiness evaluation value of the media to which the aqueous varnish is to be applied using the varnish application portion reaches less than 0.24; and a powder spraying portion that sprays powder to the media treated using the treatment portion, and a powder spraying control portion that sprays powder to the media treated using the treatment portion using the powder spraying portion in a case in which the temperatures of the media detected using the temperature detection portion exceeds 40° C.

14. A method for applying varnish, comprising:

a printing step of forming images on media using ink;

a varnish application step of applying aqueous varnish to the media using a varnish application portion after the printing step;

a treatment step of performing a treatment on the media so that a stickiness evaluation value reaches 0.24 or less, which is the stickiness evaluation value indicating a degree of stickiness of the aqueous varnish applied to the media when the media to which the aqueous varnish is applied in the varnish application step are output from the varnish application portion and being derived using a damped vibration percentage of a pendulum caused to do pendulum motions from an arbitrary location of the media where the aqueous varnish is applied, wherein the arbitrary location of the media is used as a pivot for the pendulum to perform the pendulum motions;

an accumulation step of accumulating the media after the varnish application step and the treatment step; and a temperature detection step of detecting temperatures of the media after the varnish application step and prior to the accumulation step, wherein the treatment step includes:

a cooling treatment step of performing a cooling treatment on the media after the varnish application step and prior to the accumulation step, and a cooling treatment control step of controlling temperatures of the media on which the cooling treatment is perfonned in the cooling treatment step by applying cooling conditions under which the stickiness evaluation value of the media to which the aqueous varnish is to be applied in the varnish application step reaches less than 0.24; and a powder spraying step of spraying powder to the media treated in the treatment step, and a powder spraying control step of spraying powder to the media treated in the powder spraying step in a case in which the temperatures of the media detected in the temperature detection step exceeds 40° C.

* * * * *